United States Patent [19]

Edo

[11] Patent Number: 4,917,009

[45] Date of Patent: Apr. 17, 1990

[54] METHOD AND APPARATUS FOR CONTINUOUSLY DEWATERING SLUDGE, FRUITS AND VEGETABLES AND WASTES OF PROCESSED FRUITS AND VEGETABLES

[76] Inventor: Masahiko Edo, 6-9-2 Kurokami, Kumamoto, Kumamoto, Japan

[21] Appl. No.: 232,683

[22] Filed: Aug. 16, 1988

[30] Foreign Application Priority Data

| | | | |
|---|---|---|---|
| Mar. 11, 1988 | [JP] | Japan | 63-59071 |
| Mar. 11, 1988 | [JP] | Japan | 63-59072 |
| Jun. 21, 1988 | [JP] | Japan | 63-153881 |

[51] Int. Cl.[4] ..... B30B 9/24; B30B 9/20

[52] U.S. Cl. ..... 100/118; 100/121; 100/153; 210/400; 162/358; 99/495

[58] Field of Search ..... 100/37, 98 R, 116, 118, 100/119, 120, 121, 153, 155 R, 176; 99/495, 510; 162/358, 314, 205, 210, 361; 210/400, 386, 401, 402

[56] References Cited

U.S. PATENT DOCUMENTS

| | | | |
|---|---|---|---|
| 921,921 | 5/1909 | Vernsten | 100/118 |
| 3,176,607 | 4/1965 | Lapham | 210/400 X |
| 3,520,251 | 7/1970 | Bodine | 100/121 X |
| 3,527,668 | 9/1970 | Kusters et al. | 162/358 X |
| 3,530,791 | 9/1970 | Flotte | 100/120 |
| 4,071,925 | 2/1978 | Folk | 100/153 X |

FOREIGN PATENT DOCUMENTS

| | | | |
|---|---|---|---|
| 634191 | 8/1936 | Fed. Rep. of Germany | 100/121 |
| 34599 | 12/1961 | German Democratic Rep. | 100/153 |
| WO87/04114 | 7/1987 | PCT Int'l Appl. | 100/121 |
| 721341 | 8/1980 | U.S.S.R. | 100/118 |
| 1257470 | 12/1971 | United Kingdom | 100/121 |

*Primary Examiner*—Harvey C. Hornsby
*Assistant Examiner*—Stephen F. Gerrity
*Attorney, Agent, or Firm*—Cushman, Darby & Cushman

[57] ABSTRACT

A continuous dewatering apparatus comprises left and right dewatering drum gears meshing with each other and disposed in a frame. Each of the drum gears is formed of a hollow cylindrical drum having many teeth formed on the periphery thereof. Many water passage holes are formed through the tooth crests and bottom lands of the teeth of the hollow drum. Left and right endless filter cloth belts are stretched around the drum gears and left and right roller groups disposed in the vicinity of the drum gears. The filter cloth belts may directly be adhered to the drum gears. The left and right drum gears and cloth belts are rotated together by a driving unit to mesh with each other. Objects such as sludge, fruits and vegetables and wastes of processed fruits and vegetables are continuously charged onto a meshing location of the drum gears and cloth belts to dewater the objects by pressing force of the meshing drum gears. As a result, the objects are continuously dewatered at a high dewatering rate.

1 Claim, 25 Drawing Sheets

METHOD AND APPARATUS FOR CONTINUOUSLY DEWATERING SLUDGE, FRUITS AND VEGETABLES AND WASTES OF PROCESSED FRUITS AND VEGETABLES

BACKGROUND OF THE INVENTION

1. Field of the Invention

The present invention relates to a method and an apparatus for continuously dewatering sludge, fruits and vegetables and wastes of processed fruits and vegetables.

2. Description of the Prior Art

Centrifugal dewatering apparatuses, vacuum dewatering apparatuses and pressure dewatering apparatuses are used to dewater the sludge, fruits and vegetables and wastes of processed fruits and vegetables.

However, the centrifugal or vacuum dewatering apparatuses are incapable of continuously dewatering such objects to be dewatered and they are expensive. There is a dewatering apparatus using a belt filter to realize a continuous dewatering operation. However, this apparatus cannot sufficiently compress objects to be dewatered so that a dewatering rate remains at 40% to 50% that is far from a perfect dewatering.

SUMMARY OF THE INVENTION

An object of the present invention is to provide a method of continuously dewatering objects such as sludge, fruits and vegetables and wastes of processed fruits and vegetables. The method comprises the steps of meshing left and right dewatering drum gears with each other and rotating them to guide left and right endless filter cloth belts, charging the objects onto meshing surfaces of the endless filter cloth belts, and dewatering the objects by virtue of pressing force of the meshing drum gears. The method realizes a high dewatering rate as well as a continuous dewatering operation. The present invention also provides an apparatus for realizing the above-mentioned method.

Another object of the present invention is to provide a method of continuously dewatering sludge, fruits and vegetables and wastes of processed fruits and vegetables, comprising the steps of meshing left and right dewatering drum gears each having many water passage holes formed through the tooth crests and bottom lands of the gears as well as having a filter cloth adhered to an outer surface of the drum gear, dropping objects to be dewatered to a meshing location of the drum gears, and dewatering the objects by virtue of meshing pressure of the drum gears. The method realizes a high dewatering rate as well as a continuous dewatering work. The present invention also provides an apparatus for realizing the above-mentioned method.

According to the present invention, the objects to be dewatered are compressed and dewatered by the meshing force of the dewatering drum gears so that the objects can continuously be dewatered at a high dewatering rate with a simple structure that will be manufactured at a low cost.

These and other objects, features and advantages of the present invention will be more apparent from the following detailed description of preferred embodiments in conjunction with the accompanying drawings.

DETAILED DESCRIPTION OF THE EMBODIMENTS

First Embodiment

FIGS. 1 to 32 show a continuous dewatering apparatus according to the first embodiment of the present invention.

Figure 1:
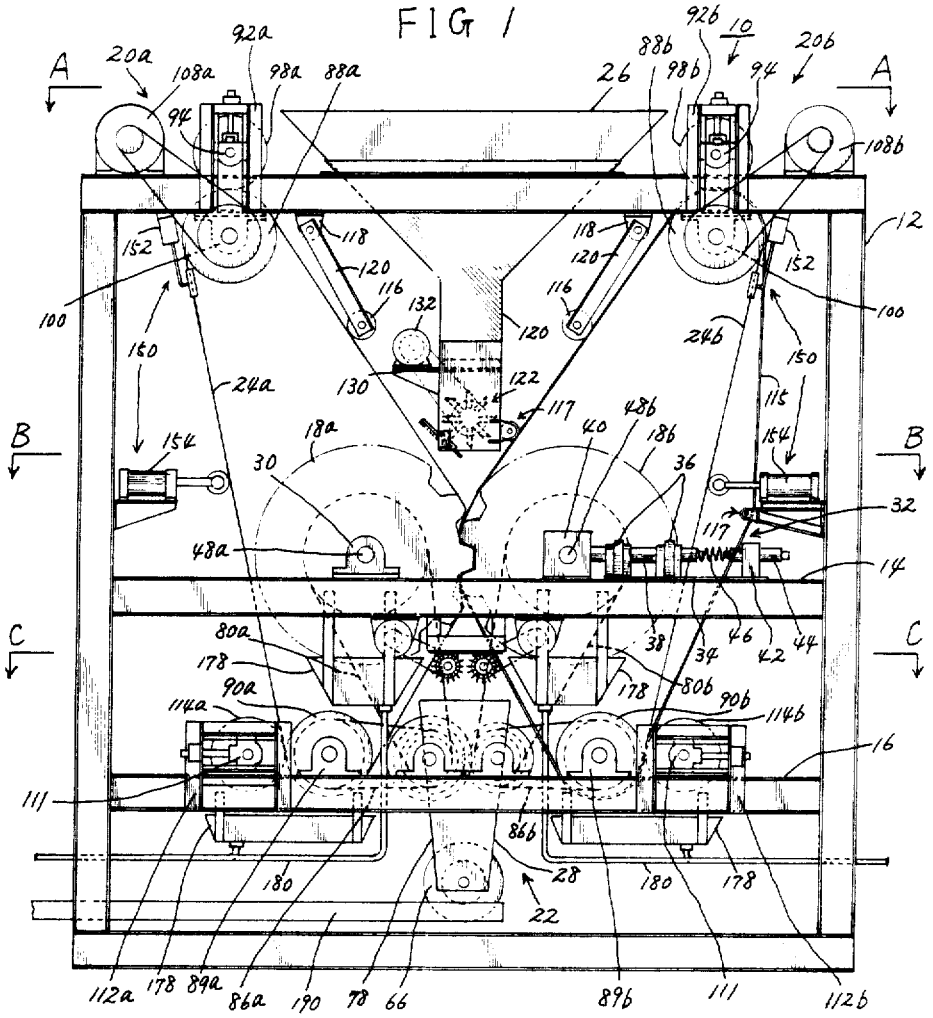
FIG. 1 is a front view showing essential part of a continuous dewatering apparatus according to a first embodiment of the present invention.

FIG. 1 is a front view showing a continuous dewatering apparatus 10. A frame 12 has an upper horizontal frame 14 and a lower horizontal frame 16 that are fixed in parallel with each other to the frame 12. At a central portion of the upper horizontal frame 14, a left dewatering drum gear 18*a* and a right dewatering drum gear 18*b* are supported. Left and right roller groups 20*a* and 20*b* are disposed in the vicinity of the left and right dewatering drum gears 18*a* and 18*b*, respectively.

The continuous dewatering apparatus 10 comprises the left and right dewatering drum gears 18*a* and 18*b*, a main driving unit 22 including a motor, the left and right roller groups 20*a* and 20*b*, left and right endless filter cloth belts 24*a* and 24*b*, a charging hopper 26, and a collecting means (collecting hopper) 28. Each of the drum gears 18*a* and 18*b* has many teeth formed on the periphery thereof. Many water passage holes are formed through the tooth crests and bottom lands of the teeth of the drum gear. By virtue of meshing pressure of the drum gears 18*a* and 18*b*, objects to be dewatered are compressed and dewatered. The separated water is drained into the drum gears 18*a* and 18*b* through the cloth belts 24*a* and 24*b* then to the outside of the apparatus 10.

As shown in FIG. 1, bearings 30 are fixed to a central upper surface of the upper horizontal frame 14 on the front and back sides, respectively. Also, movable bearing mechanisms 32 each with a spring are disposed to face the bearings 30.

Figure 18:
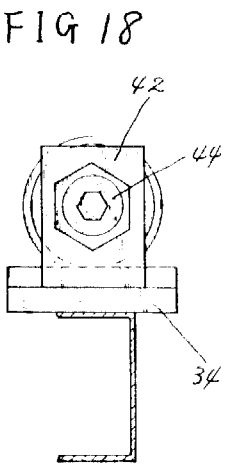
FIG. 18 is an explanatory side view showing essential part of the movable bearing mechanism with spring.
Figure 16:
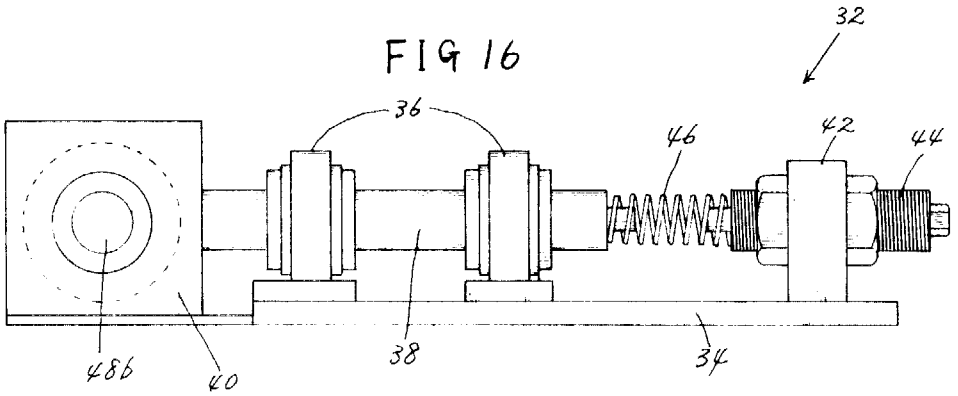
FIG. 16 is an explanatory front view showing essential part of a movable bearing mechanism with spring.
Figure 17:
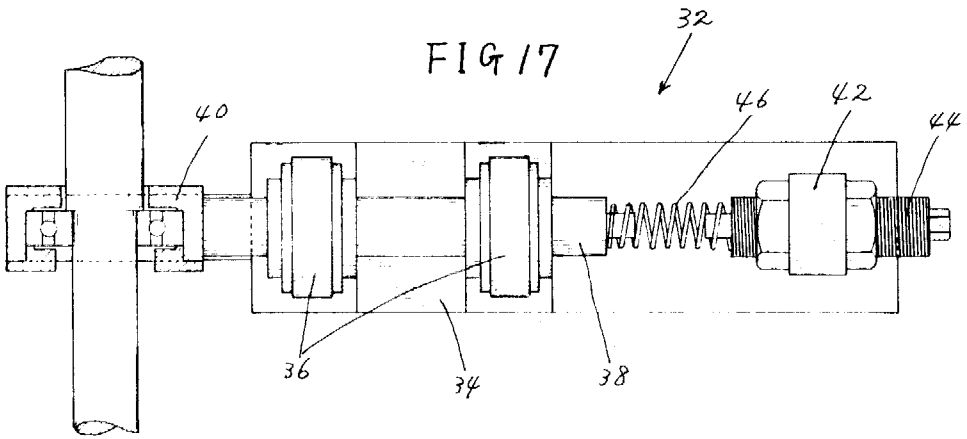
FIG. 17 is an explanatory plan view showing essential part of the movable bearing mechanism with spring.

In FIGS. 16 to 18, each of the movable bearing mechanisms 32 comprises a pair of metals 36 fixed to a base 34, a bearing 40, a supporting shaft 38 passing through the bearing 40 and metals 36, 36, a nut metal 42 fixed to another end of the base 34, a bolt shaft 44 screwed into the nut metal 42, and a spring 46 interposed between the supporting shaft 38 and the bolt shaft 44. The movable bearing mechanisms 32 always push the left and right dewatering drum gears 18*a* and 18*b* toward their meshing direction by spring force, and are movable back and forth in the meshing direction.

The bearings 30 and the movable bearing mechanisms 32 are disposed to face each other on the upper horizontal frame 14 that is in parallel with the frame 12. A rotary shaft 48*a* of the left drum gear 18*a* is supported by the bearings 30, while a rotary shaft 48*b* of the right drum gear 18*b* is supported by the bearings 40 of the bearing mechanisms 32 such that the drum gears 18*a* and 18*b* mesh with each other and rotate together.

Left and right chain pulleys 49*a* and 49*b* are fixed to ends (on rear side of the figure) of the rotary shafts 48*a* and 48*b* of the left and right dewatering drum gears 18*a* and 18*b*, respectively.

As shown in FIGS. 19, 22, 23 and 32, each of the drum gears 18*a* and 18*b* is made of a metallic hollow cylindrical drum 50 whose both side faces are sealed. The drum 50 is provided with a plurality of elastic teeth 54. Each of the teeth 54 comprises an elastic base portion 51 disposed on the periphery of the drum 50 to form a bottom land, and a tooth head portion 53 protruding from the elastic base portion 51 to form a tooth crest. The elastic teeth 54 are independently fixed to the drum 50 with fitting members 60.

Figure 19:
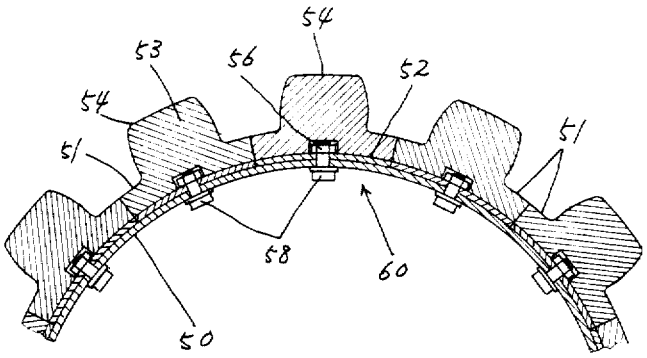
FIG. 19 is an enlarged sectional view showing essential part of teeth of a dewatering drum gear.
Figure 20:
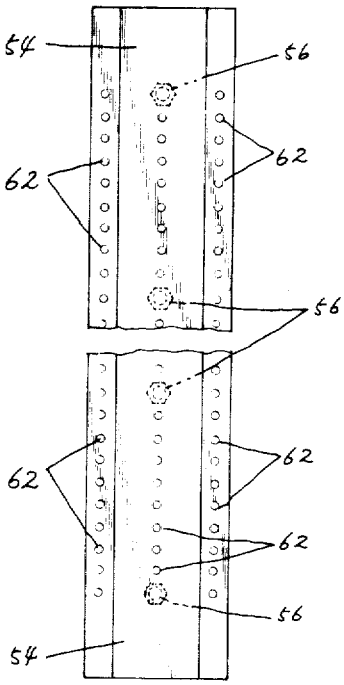
FIG. 20 is an enlarged plan view showing essential part of the tooth of the dewatering drum gear.

As shown in FIG. 19, the tooth head portion 53 has substantially a rectangular cross section. Under the elastic base 51 of the tooth 54, a metal base 52 is fixed, and nuts 56 are embedded in the elastic base 51. From the inside of the drum 50, bolts 58 are screwed into the nuts 56 through the metal base 51 and the elastic base 52 to fix the tooth 54 to the drum 50. The nuts 56 and bolts 58 constitute the fitting member 60.

As described in the above, the teeth 54 are independently fitted to the drum 50 of each of the drum gears 18*a* and 18*b*. As a result, the drum 50 and teeth 54 may be formed easily to reduce the manufacturing cost of the drum gears 18*a* and 18*b*.

Figure 24:
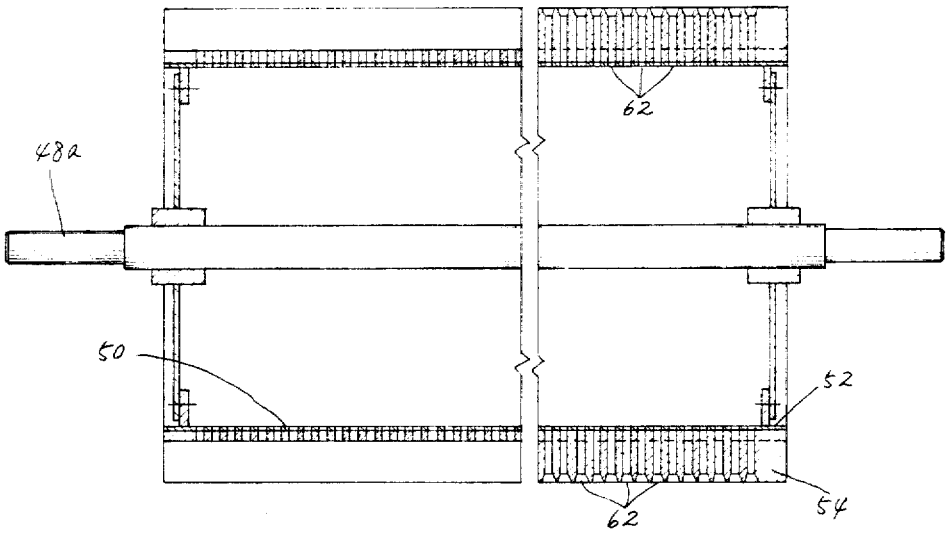
FIG. 24 is an enlarged sectional view taken along lines C—C and D—D of FIG. 23.
Figure 23:
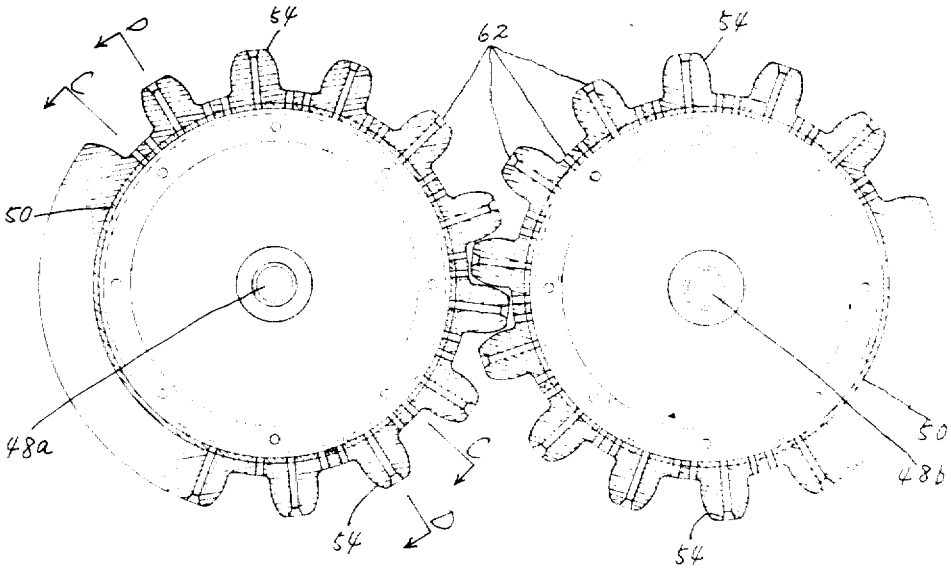
FIG. 23 is an enlarged vertical section of the dewatering drum gear.
Figure 25:
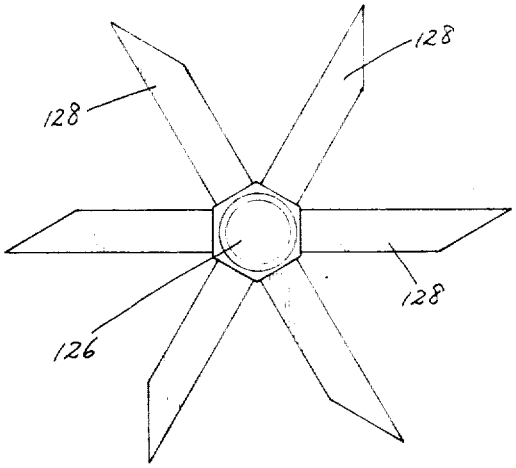
FIG. 25 is an enlarged side view showing a rotary cutter.

As shown in FIGS. 23 and 24, the teeth 54 have many water passage holes 62 formed through the tooth crests and bottom lands of the teeth 54. Through these holes 62, the outside and the hollow inside of each of the drum gears 18*a* and 18*b* communicate with each other.

The main driving unit 22 is disposed at lower part of the frame 12. The main driving unit 22 comprises a main motor 66 and a transmission mechanism 67 to drive the drum gears 18*a* and 18*b* as well as left and right dewatering rollers 90*a* and 90*b* to be described later.

Figure 2:
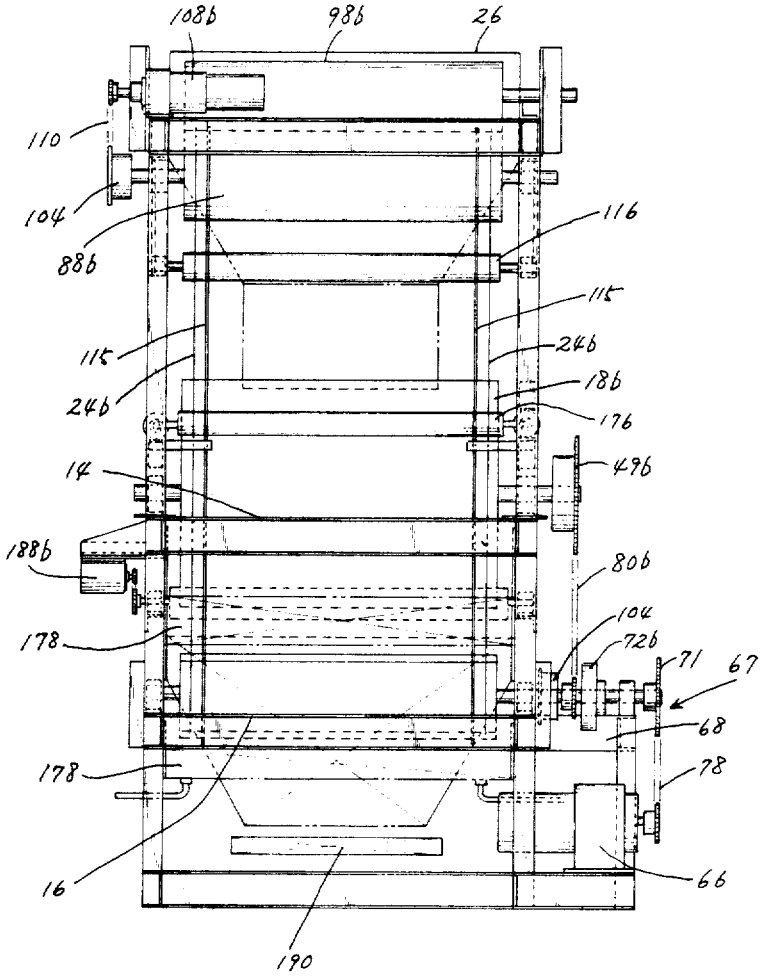
FIG. 2 is a right side view showing the continuous dewatering apparatus.
Figure 3:
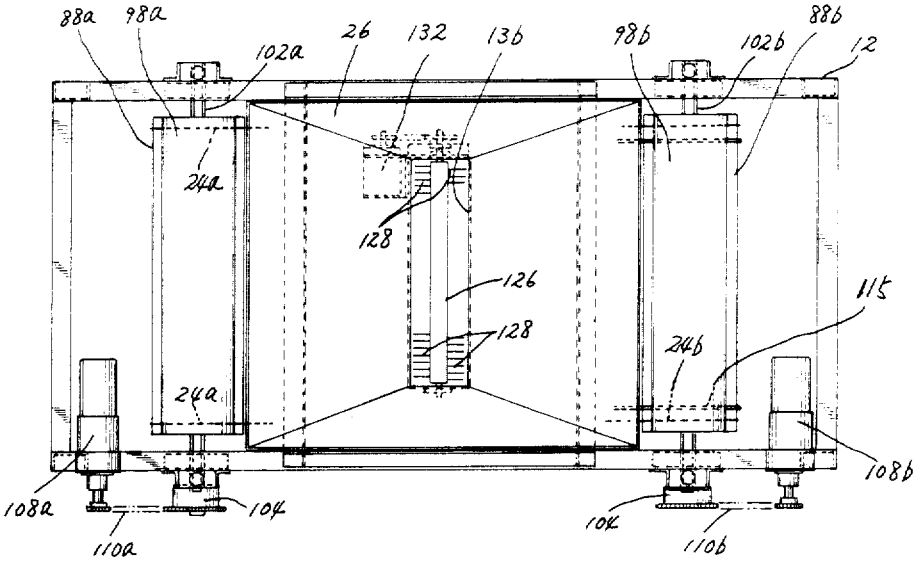
FIG. 3 is a sectional view taken along a line A—A of FIG. 1.
Figure 12:
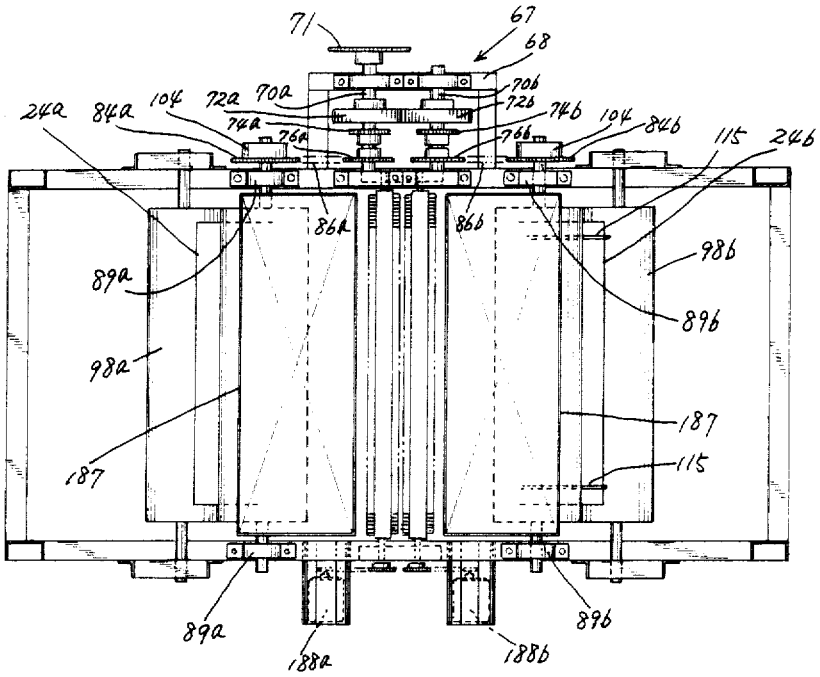
FIG. 12 is a sectional view taken along a line C—C of FIG. 1.
Figure 13:
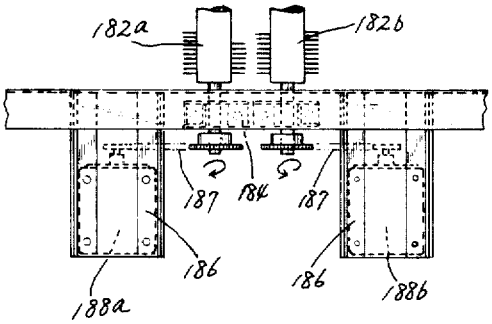
FIG. 13 is an explanatory view showing the driving and fitting states of left and right brush rollers.
Figure 14:
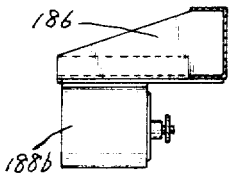
FIG. 14 is an explanatory side view showing a fitting state of a brush driving motor.
Figure 15:
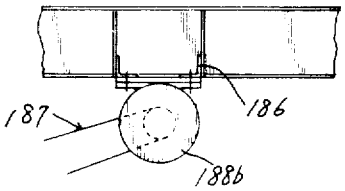
FIG. 15 is an explanatory front view showing the fitting state of the brush driving motor.

As shown in FIGS. 2 and 12, the main motor 66 is disposed at a central lower position of the frame 12 on the rear side of the frame 12. A chain pulley 65 is fixed to a driving shaft of the main motor 66. Above the main motor 66, a receiver frame 68 protrudes.

The transmission mechanism 67 includes left and right rotary shafts 70a and 70b supported by bearings fixed on the receiver frame 68. The left and right rotary shafts 70a and 70b support left and right gears 72a and 72b meshing with each other, left and right first chain pulleys 74a and 74b, and left and right second chain pulleys 76a and 76b. A chain pulley 71 is fixed to an end of the left rotary shaft 70a. An endless chain 78, left and right first endless chains 80a and 80b and left and right second endless chains 86a and 86b are stretched around the corresponding gears and pulleys, respectively.

The bearings for supporting the left and right rotary shafts 70a and 70b are disposed on the receiver frame 68 and lower horizontal frame 16. An end of the left rotary shaft 70a protrudes from the receiver frame 68 to fix the chain pulley 71. In the receiver frame 68, the left rotary shaft 70a fixedly and coaxially supports the left gear 72a, left first chain pulley 74a and left second chain pulley 76a. Similarly, the right rotary shaft 70b fixedly and coaxially supports the right gear 72b meshing with the left gear 72a, the right first chain pulley 74b and the right second chain pulley 76b.

The endless chain 78 is stretched around the chain pulley 65 fixed to the shaft of the main motor 66 and the chain pulley 71. The left and right first endless chains 80a and 80b are stretched around the left and right first chain pulleys 74a and 74b and the left and right chain pulleys 49a and 49b fixed to the rotary shafts of the left and right drum gears 18a and 18b, respectively. The left and right second endless chains 86a and 86b are stretched around left and right third chain pulleys 84a and 84b fixed to the left and right dewatering rollers 90a and 90b and the left and right second chain pulleys 76a and 76b, respectively.

With this arrangement, torque of the main motor 66 rotates the rotary shafts 70a and 70b via the endless chain 78 and left gear 72a to rotate the left and right dewatering drum gears 18a and 18b meshing with each other.

In the vicinity of the drum gears 18a and 18b, the left and right roller groups 20a and 20b are disposed to rotate in connection with the rotation of the drum gears 18a and 18b.

The left and right roller groups 20a and 20b comprise left and right supporting rollers 88a and 88b disposed substantially above the left and right dewatering drum gears 18a and 18b and supported by bearings fixed to upper part of the frame 12, and left and right dewatering rollers 90a and 90b disposed substantially under the left and right dewatering drum gears 18a and 18b to dewater the left and right endless filter cloth belts 24a and 24b.

Figure 4:
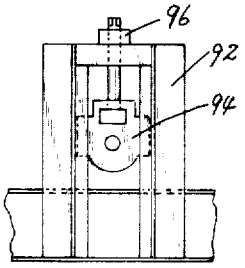
FIG. 4 is a front view showing essential part of a guide frame.
Figure 5:
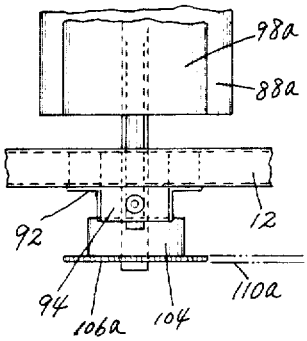
FIG. 5 is a plan view showing essential part of the guide frame.
Figure 6:
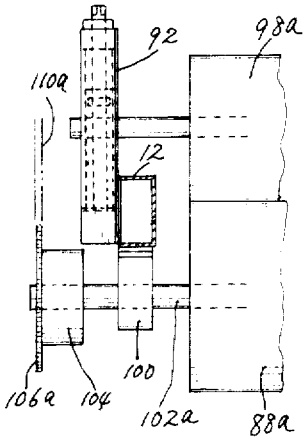
FIG. 6 is an explanatory side view showing the guide frame and a supporting roller.
Figure 7:
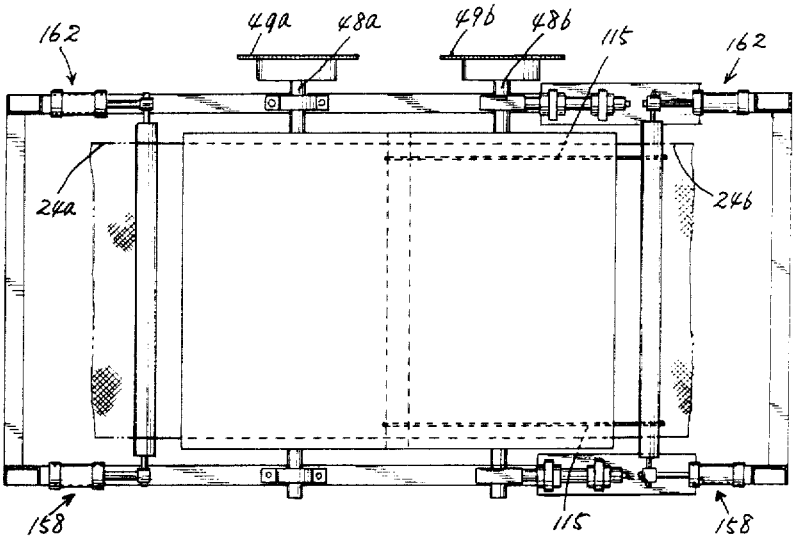
FIG. 7 is a sectional view taken along a line B—B of FIG. 1.
Figure 8:
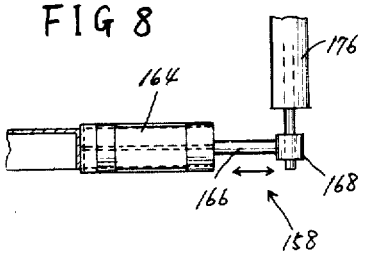
FIG. 8 is a plan view showing essential part of a first cylinder mechanism.

As shown in FIGS. 4 to 6, left and right first guide frames 92a and 92b are fixed at upper side ends of the frame 12 on the front and rear sides of the frame 12, respectively. In each of the first guide frames 92a and 92b, a bearing 94 provided with a collar that is slidably guided by guide grooves of the first guide frame. The bearing 94 is connected to an end of an adjusting bolt 96 that is rotated to vertically adjust the bearing 94.

The bearings 94 support each of shafts of left and right first presser rollers 98a and 98b that are pressed against the supporting rollers 88a and 88b respectively.

In the vicinity of the fitting positions of the left and right first guide frames 92a and 92b, bearings 100 are fixed to the frame 12. The bearings 100 support shafts 102a and 102b of the left and right supporting rollers 88a and 88b. Ends of the shafts 102a and 102b are provided with torque limiters 104 to which left and right fourth chain pulleys 106a and 106b are fixed.

The torque limiter 104 is so constituted that, when load exceeding a stipulated value is applied to the torque limiter, the torque transmission is disconnected with respect to the corresponding shaft.

On the frame 12, left and right first motors 108a and 108b are fixed in the vicinity of the left and right supporting rollers 88a and 88b, respectively. Chain pulleys are fixed to output shafts of the motors 108a and 108b, and left and right third endless chains 110a and 110b are stretched around the chain pulleys of the motors 108a and 108b and the chain pulleys 106a and 106b of the supporting rollers 88a and 88b, respectively.

Accordingly, the torque of the left and right first motors 108a and 108b is transmitted to the left and right supporting rollers 88a and 88b via the left and right fourth chain pulleys 106a and 106b, respectively.

The left and right first motors 108a and 108b are electrically connected to the main motor 66 and interlocked with the main motor 66.

Bearings 89a and 89b are fixed on the lower horizontal frame 16 on the front and rear sides of the frame 12 under the left and right dewatering drum gears 18a and 18b. The bearings 89a and 89b support the left and right dewatering rollers 90a and 90b. Ends of the dewatering rollers 90a and 90b are provided with torque limiters 104 similar to those provided for the supporting rollers 88a and 88b.

In the vicinity of the left and right dewatering rollers 90a and 90b, left and right second guide frames 112a and 112b are fixed on the horizontal frame 16. The frames 112a and 112b have the similar constitutions as those of the first guide frames 92a and 92b. The frames 112a and 112b support bearings 111 that support the left and right dewatering receiver rollers 114a and 114b. The rollers 114a and 114b are pressed against the dewatering rollers 90a and 90b, respectively. The left and right dewatering receiver rollers 114a and 114b hold the left and right endless filter cloth belts 24a and 24b against the dewatering rollers 90a and 90b to dewater the filter cloth belts 24a and 24b.

As shown in FIG. 1, the left endless filter cloth belt 24a is stretched around the left dewatering drum gear 18a, left supporting roller 88a and left dewatering roller 90a, while the right endless filter cloth belt 24b is stretched around the right dewatering drum gear 18b, right supporting roller 88b and right dewatering roller 90b.

The left and right endless filter cloth belts 24a and 24b are woven from flax fibers, chemical fibers, etc., to have high moisture content and strength.

In the figure, each of the left and right endless filter cloth belts 24a and 24b is stretched to form an acute triangle with an obtuse angle at the corresponding one of the dewatering drum gears 18a and 18b. Due to this shape, contacting portions between the left and right endless filter cloth belts 24a and 24b and the dewatering drum gears 18a and 18b are reduced to prevent the belts 24a and 24b from wearing easily.

It has been proved from experiments that a most effective traveling speed of the belts 24a and 24b in a dewatering operation is 40 to 50 cm/sec.

As shown in FIGS. 1 and 2, annular soft rubbers 115 are disposed along both side edges of the right endless filter cloth belt 24b that is stretched around the right dewatering drum gear 18b, right supporting roller 88b and right dewatering roller 90b. The annular soft rubber strips 115 elastically tighten the belt 24b inwardly while traveling together with the belt 24b to prevent dewatered cakes and separated water from flowing sideward from a meshing portion of the dewatering drum gears 24a and 24b. Contact position regulating mechanisms 117 are arranged in the vicinity of traveling passages of the annular soft rubber strips 115 to regulate the contact positions of the annular soft rubber strips 115 on the right belt 24b.

Each of the annular soft rubber strips 115 is formed of an elastic soft rubber material having a circular cross section. The two annular soft rubber strips 115 are stretched around the right filter cloth belt 24b along opposite side edges of the belt 24b, respectively.

As shown in FIGS. 21, 22, 28 and 31, one kind of the contact position regulating mechanisms 117 is disposed above the meshing location of the dewatering drum gears 24a and 24b, and comprises a roller bearing 121 supported by a supporting plate 119 protruding from a side of a square pipe portion 120, a guide roller 123 supported by the roller bearing 121 and disposed on the traveling path of the annular soft rubber strip 115 to frictionally rotate with the annular soft rubber strip 115. Another kind of the contact position regulating mechanisms 117 comprises a guide roller 129 supported by a bearing 127 that is fitted to an end of a supporting plate 125 disposed under a traveling path correcting device 154 and protruding from the frame 12.

Figure 21:
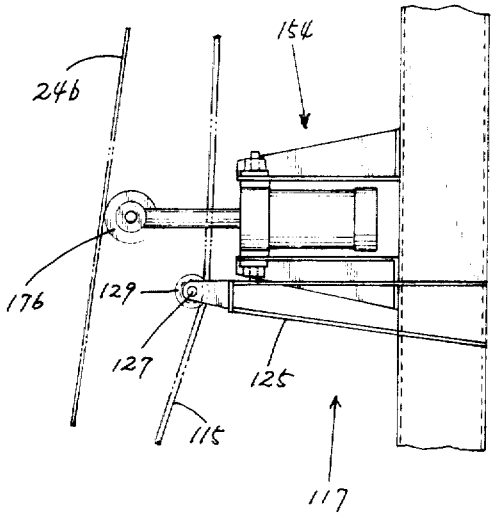
FIG. 21 is an explanatory side view showing a contact position regulating mechanism at one end.
Figure 22:
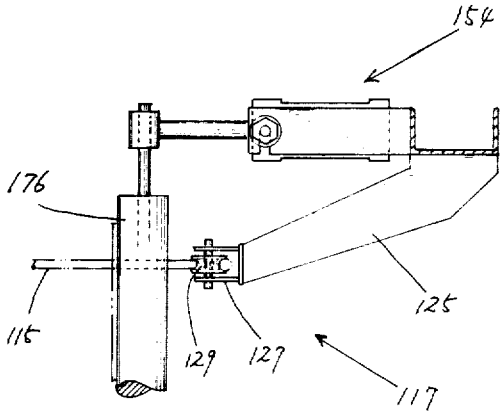
FIG. 22 is an explanatory plan view showing the contact position regulating mechanism.
Figure 28:
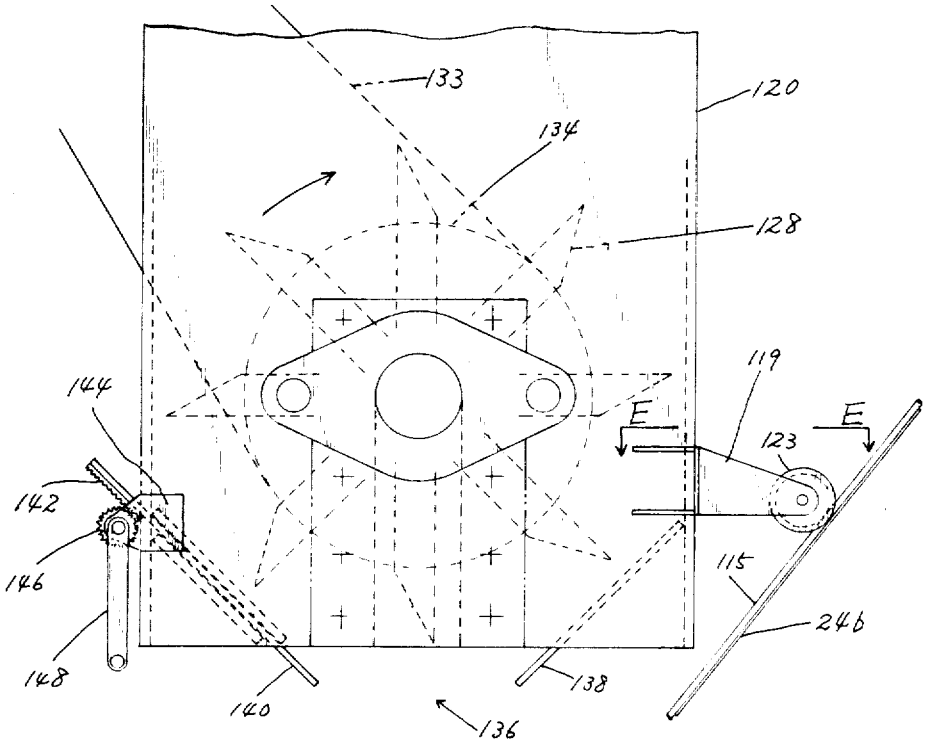
FIG. 28 is an explanatory side view showing an end portion of a discharging square pipe.
Figure 30:
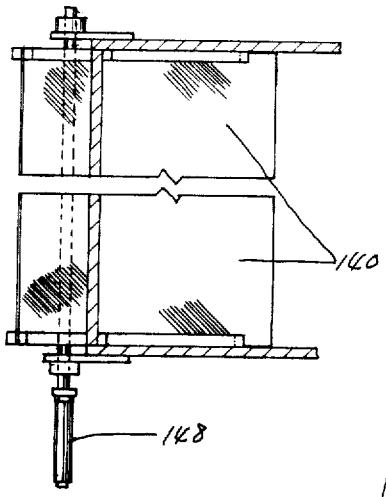
Figure 31:
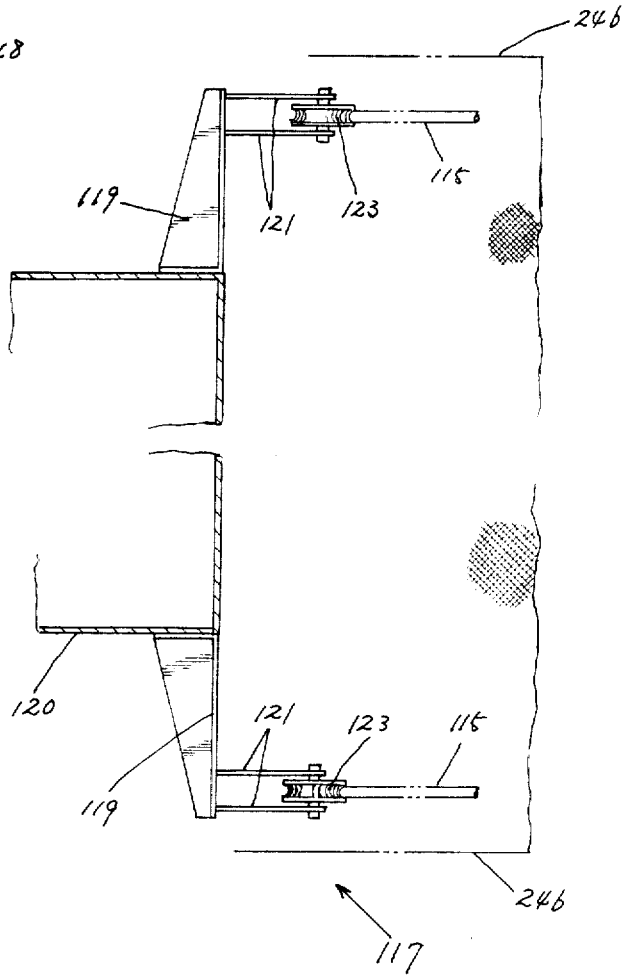
FIG. 31 is a sectional view taken along a line E—E of FIG. 28.

As shown in FIGS. 21 and 28, the guide roller 123 contacts with the outer side of the annular soft rubber strip 115, while the guide roller 129 contacts with the inner side of the rubber strip 115 such that the guide roller 129 pulls the rubber strip 115 away from the right filter cloth belt 24b. Accordingly, the annular soft rubber strips 115 are secured at side edge portions of the right endless filter cloth belt 24b to rotate together with the belt 24b. Although the annular soft rubber strips and their contact position regulating mechanism have been provided for the right filter cloth belt, they may be provided for any one of the cloth belts to prevent the dewatered cakes and separated water from flowing from the sides of the dewatering drum gears.

Upper tension rollers 116 are suspended to contact with the left and right endless filter cloth belts 24a and 24b between the left and right supporting rollers 88a and 88b and the left and right dewatering drum gears 18a and 18b, respectively. Each of the tension rollers 116 is supported by arms 120 that are supported by supporting brackets 118 fixed to the frame 12.

The tension rollers 116 always provide tension onto the left and right endless filter cloth belts 24a and 24b to prevent the belts 24a and 24b from being folded and bitten by the left and right dewatering drum gears 18a and 18b. As a result, the belts 24a and 24b are prevented from easily deteriorating, and rotate smoothly always.

The charging hopper 26 is fixed to the frame 12 at a position above the meshing location of the left and right dewatering drum gears 18a and 18b to receive objects such as sludge, fruits and vegetables and wastes of processed fruits and vegetables to be dewatered.

In FIG. 1, the charging hopper 26 is provided with the square pipe portion 120 at lower part of the hopper 26 so that the hopper 26 has a funnel-like section. In the square pipe portion 120, a rotary cutter 122 is disposed.

Figure 26:
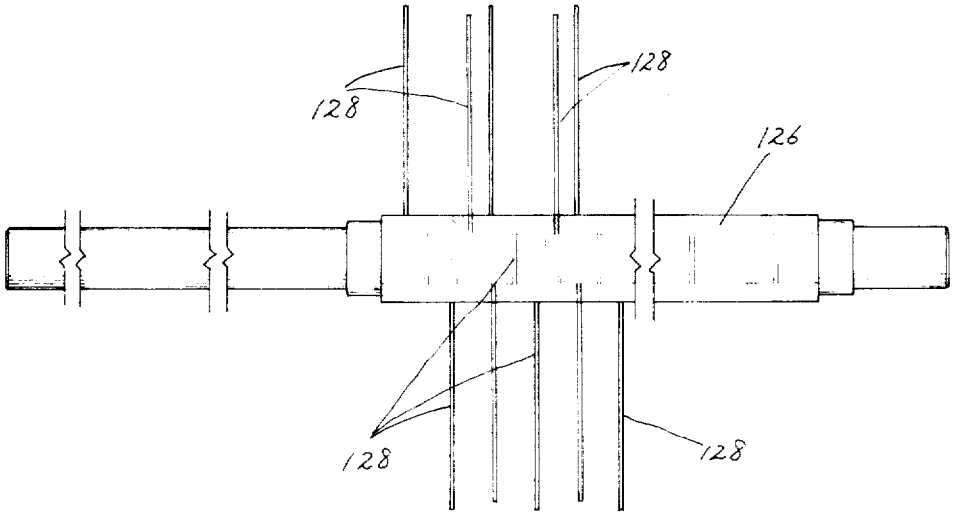
FIG. 26 is an enlarged plan view showing the rotary cutter.
Figure 27:
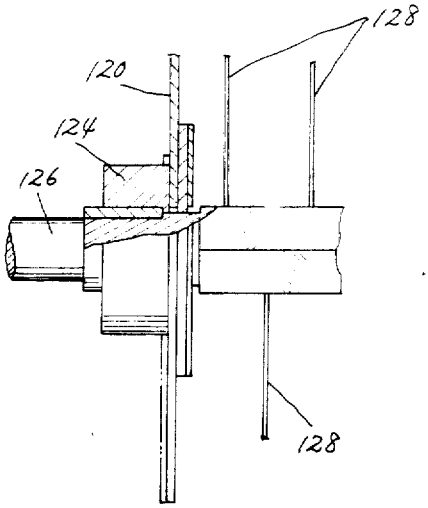
FIG. 27 is an explanatory view showing a bearing portion of the rotary cutter.
Figure 29:
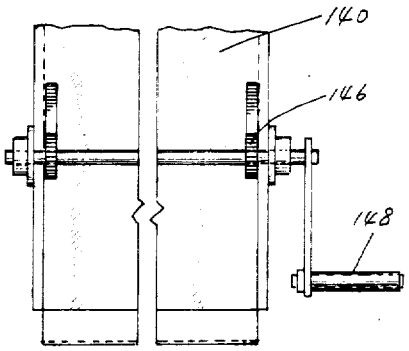
FIGS. 29 and 30 are explanatory plan views showing essential part of a moving mechanism of an adjustable inclined plate.

In FIGS. 25 to 30, bearings 124 are fixed to walls of the square pipe portion 120 to support a shaft 126 of the rotary cutter 122 through felts. The rotary cutter 122 comprises the shaft 126 and a plurality of cutter blades 128 fixed to the shaft 126. As shown in FIG. 26, the cutter blades 128 are disposed with equal intervals in an axial direction and asymmetrically on the left and right sides. With this arrangement, the objects to be dewatered are cut by the cutter blades 128 into pieces and then dropped onto the meshing location of the left and right dewatering drum gears 18a and 18b. A bracket 130 is fixed to an outer wall of the square pipe portion 120, and a cutter driving motor 132 is fixed on the bracket 130. The rotary cutter 122 is provided with a coaxial chain pulley 134, and a chain 133 is stretched around the pulley 134 and a shaft of the cutter driving motor 132 to drive the rotary cutter 122.

At an lower end of the square pipe portion 120, a fixed plate 138 inclining to narrow an outlet 136 and an inclined adjustable plate 140 are disposed. The adjustable plate 140 faces the fixed plate 138 and is movable obliquely to adjust an opening area of the outlet 136. The fixed plate 138 is inclined in a rotational direction indicated with an arrow mark in the figure. Guide grooves are formed on side walls of the square pipe portion 120 at an angle substantially the same as that of the fixed plate 138 to receive the adjustable plate 140. On the reverse side of the adjustable plate 140, a rack 142 is formed to engage with a pinion 146 supported by an end of a supporting bracket 144 that protrudes from the outer wall of the square pipe portion 120 in the vicinity of the upper end of the adjustable plate 140. An adjusting handle 148 is fixed to an end of the pinion 146. By rotating the handle 148, the adjustable plate 140 is moved to properly adjust an opening area of the outlet 136 according to the hardness of objects to be dewatered. By virtue of this, the cut pieces of the objects are thrown upward in the rotating direction of the rotary cutter 122 to improve a cutting efficiency.

In the frame 12, traveling path correcting devices 150 are disposed to correct the traveling paths of the left and right endless filter cloth belts 24a and 24b, respectively.

Each of the traveling path correcting devices comprises a sensor 152 for detecting a displacement of the traveling path of the corresponding one of the belts 24a and 24b, and a corrector 154 for correcting the traveling path of the corresponding belt according to the displacement detected by the sensor 152. The sensor 152 is disposed at an upper end of the frame 12 in the vicinity of the corresponding one of the left and right supporting rollers 88a and 88b. The sensor 152 may be a limit switch that is in an OFF state when the corresponding belt 24a or 24b is on a correct traveling path and turned ON if the belt comes out of the correct path to activate the corrector 154.

As shown in FIGS. 8 to 11, the traveling path corrector 154 includes a first cylinder mechanism 158 disposed on a supporting base 156 projecting from the central upper part of a left (right) vertical portion of the front side of the frame 12, and a second cylinder mechanism 162 fitted to a vertical supporting base 160 projecting from a left (right) vertical portion of the rear side of the frame 12. The first cylinder mechanism 158 comprises a first cylinder 164 driven by an air driving unit (not shown) on the supporting base 156, a rod 166 telescopically protruding from the inside of the first cylinder 164, and an automatic aligning bearing 168 fitted to an end of the rod 166 and having a bearing surface freely oriented according to an angle of a shaft supported by the bearing.

Figure 10:
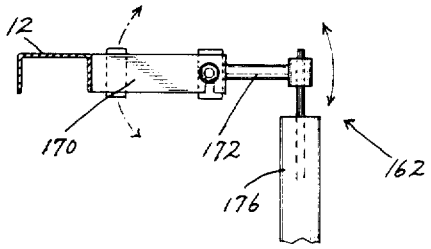
FIG. 10 is a plan view showing essential part of a second cylinder mechanism.
Figure 9:
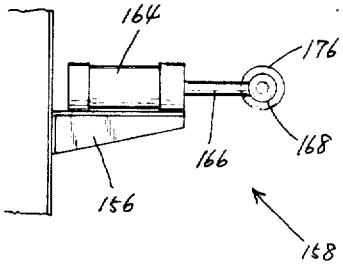
FIG. 9 is a side view showing essential part of the first cylinder mechanism.
Figure 11:
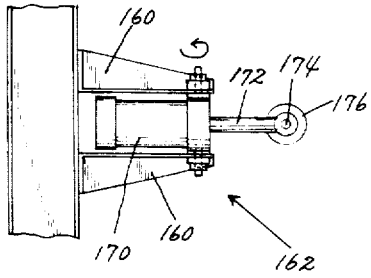
FIG. 11 is a side view showing essential part of the second cylinder mechanism.

The second cylinder mechanism 162 comprises a second cylinder 170 rotatable in a direction indicated with an arrow mark shown in FIG. 10, a rod 172 telescopically protruding from the inside of the second cylinder 170, and a bearing 174 fitted to an end of the rod 172. Between the automatic aligning bearing 168 and the bearing 174, a traveling path correcting roller 176 is disposed.

As is apparent in the figures, the rod 166 of the first cylinder mechanism 158 can move only back and forth in an axial direction of the first cylinder, while the second cylinder 170 of the second cylinder mechanism 162 rotates around a vertical axis with the rod 172 moving back and forth with respect to the second cylinder 170. Therefore, when the corresponding one of the belts 24*a* and 24*b* comes out of the correct traveling path, the proper one of the rods of the traveling path correcting corrector 154 extends so that the traveling path correcting roller 176 corrects the traveling path.

Water receiving trays 178 are disposed in the frame 12 under the left and right dewatering drum gears 18*a* and 18*b* and left and right dewatering rollers 90*a* and 90*b*, respectively. The water receiving trays are connected to a water collecting pipe 180 to drain water to the outside.

As shown in FIG. 1, a base 184 is projectingly disposed under and at the center of the upper horizontal frame 14. Bearings are fitted to the base 184 to support left and right brush rollers 182*a* and 182*b* that contact with the lower surfaces of the left and right endless filter cloth belts 24*a* and 24*b*, respectively.

In the vicinity of the base 184, base 186 are projectingly disposed to support left and right brush driving motors 188*a* and 188*b* that are connected to the left and right brush rollers 182*a* and 182*b* with chains 184, respectively.

The collecting hopper 28 is disposed in the frame 12 under the meshing location of the left and right dewatering drum gears 18*a* and 18*b* and under the left and right brush rollers 182*a* and 182*b* to collect dewatered cakes. An outlet of the collecting hopper 28 converges downwardly. A discharge conveyer 190 is disposed under the collecting hopper 28 and extends to the outside of the frame 12 to discharge the dewatered cakes from the collecting hopper 28 to the outside.

Figure 32:
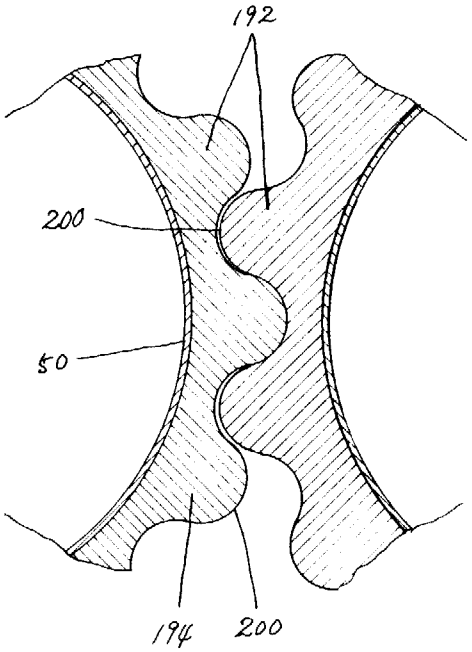
FIG. 32 is an enlarged sectional view showing teeth of left and right drum gears according to another embodiment of the present invention.

FIG. 32 shows another embodiment of teeth formed on each of the left and right dewatering drum gears. In the figure, a tooth 54 has an arcuate protruding portion 192 to form a curved surface 194 having a corrugated section. With these teeth, both the drum gears smoothly mesh with each other and rotate to dewater objects.

FIGS. 46 to 49 shown an modification of the first embodiment of the present invention.

According to the modification, each of left and right dewatering drum gears 18*a* and 18*b* is formed of a hollow cylindrical drum 50. The periphery of the drum 50 is provided with many elastic teeth 54, and many water passage holes 62 are formed through the tooth crests and bottom lands of the teeth 54. Further, the periphery of the drum 50 is covered with a mesh filter cloth 232. Scraper blades 234 are disposed to contact with outer surfaces of left and right endless filter cloth belts 24*a* and 24*b* around left and right dewatering rollers 90*a* and 90*b*, respectively.

Figure 46:
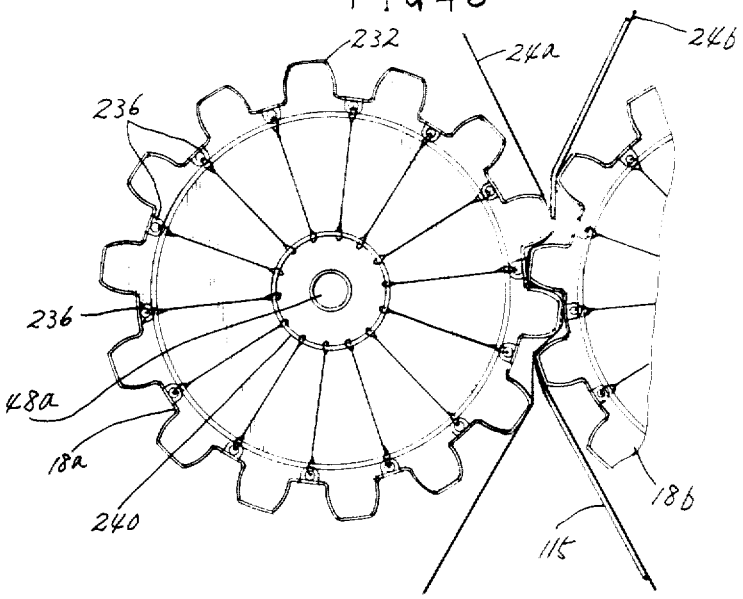
FIG. 46 is a front view showing essential part of left and right dewatering drum gears according to a modification of the first embodiment of the present invention.
Figure 47:
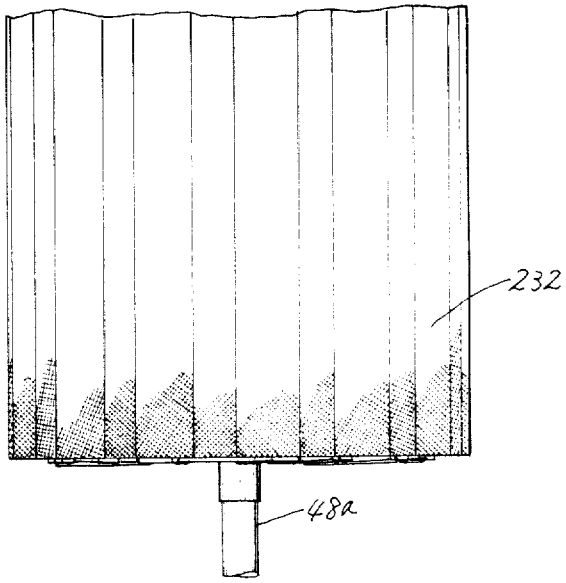
FIG. 47 is a plan view showing essential part of the dewatering drum gear of the modification.

As shown in FIGS. 46 and 47, the mesh filter cloth 232 is provided with a plurality of fitting rings 236 at positions corresponding to the positions of the bottom lands of the teeth 54 on both sides of the dewatering drum gear 18*a* (18*b*). The fitting rings 236 are connected with elastic cords 238 to pulling rings 240 which are substantially concentric with a rotary shaft 48*a* (48*b*). The mesh filter cloth 232 is made of coarse fabric such as cotton fabric with high water absorption and elasticity.

With this arrangement, water absorbed by the belts 24*a* and 24*b* is quickly absorbed by the mesh filter cloths 232 and drained into the dewatering drum gears 18*a* and 18*b* through the water passage holes 62 to perfectly dewater objects to be dewatered.

Figure 48:
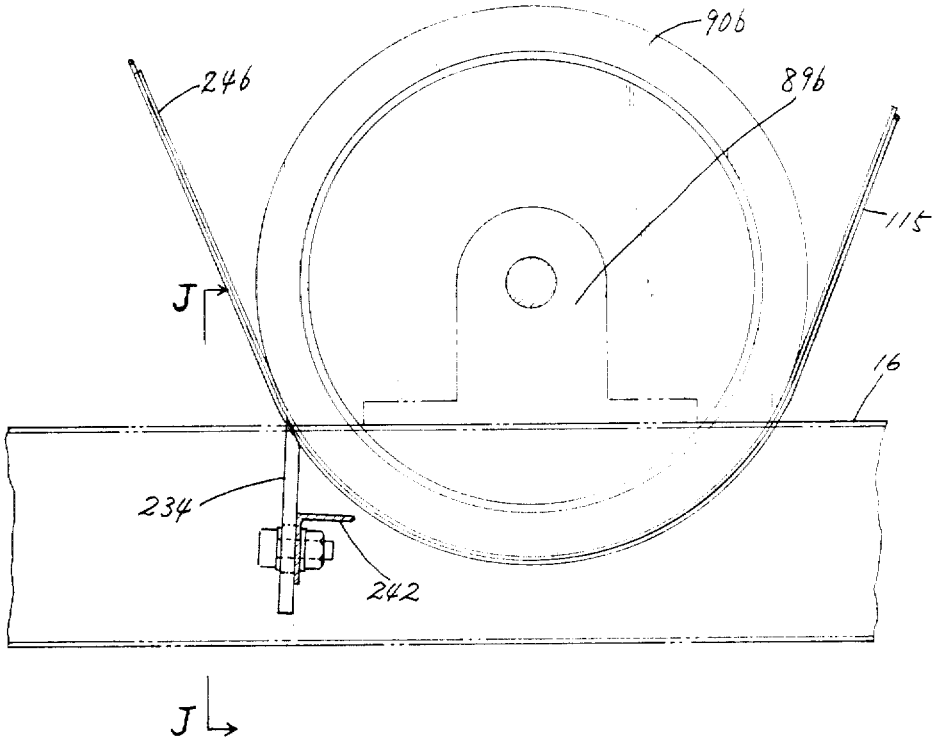
FIG. 48 is a front view showing essential part of a scraper blade.
Figure 49:
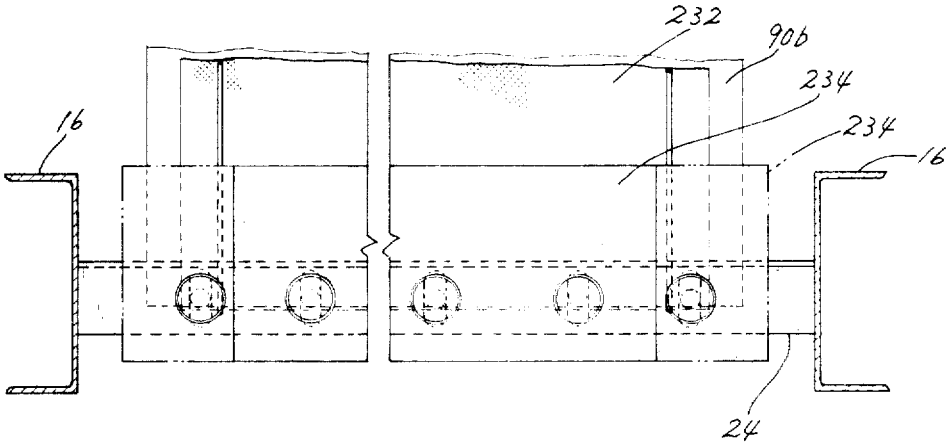
FIG. 49 is a sectional view taken along a line J—J of FIG. 48.

As shown in FIGS. 48 and 49, the scraper blades 234 are fixed with bolts to support frames 242 that are fixed to lower horizontal frames 16. The scraper blades 234 are arranged to contact with the outer surfaces of the belts 24*a* and 24*b* respectively, and an edge of each blade 234 is oriented against a traveling direction of the belt to scrape the belt and remove substances adhered to the belt. Therefore, the scraper blades 234 and left and right brush rollers 182*a* and 182*b* keep the water absorption of the belts 24*a* and 24*b* excellent at all times.

In FIG. 49, the scraper blade 234 indicated with a continuous line is arranged for the right dewatering roller 90*b*, while the scraper blade 234 indicated with a dash line is for the left dewatering roller 90*a*.

An operation of the continuous dewatering apparatus 10 will be described.

The main motor 66 rives the left and right rotary shafts 70*a* and 70*b* supported by the receiver frame 68 of the frame 12. Then, the left and right dewatering drum gears 18*a* and 18*b*, left and right dewatering rollers 90*a* and 90*b* are rotated. At the same time, the left and right supporting rollers 88*a* and 88*b* are driven by the left and right first motors 108*a* and 108*b* to move the left and right endless filter cloth belts 24*a* and 24*b* in contact with the drum gears 18*a* and 18*b*, respectively.

Objects to be dewatered are charged into the charging hopper 26 and cut in pieces with the rotary cutter 122 disposed in the square pipe portion 120.

Then, the objects drop on the meshing drum gears 18*a* and 18*b* and the belts 24*a* and 24*b*. The objects are pressed by meshing force of the teeth 54 of the drum gears 18*a* and 18*b* such that the water content of the objects is drained into the drum gears 18*a* and 18*b* through the water passage holes 62 formed through the tooth crests and bottom lands of the teeth.

At the time, the annular soft rubber strips 115 stretched around the right endless filter cloth belt 24*b* are held between the teeth of the drum gears 18*a* and 18*b* to secure watertightness at both sides of the meshing teeth of the drum gears 18*a* and 18*b*. Accordingly, dewatered cakes and separated water are prevented from flowing sideward from the drum gears 18*a* and 18*b*, and successfully collected in the drum gears 18*a* and 18*b* and in the collecting hopper 28.

Depending on a remaining amount of the dewatered cakes of the objects, the movable bearing mechanism 32 with spring supporting the rotary shaft 48*b* of the right dewatering drum gear 18*b* slides rightward against spring force of the coil spring 46 to adjust a meshing gap between the drum gears 18*a* and 18*b*.

The water flown into the left and right dewatering drum gears 18*a* and 18*b* flows down into the water receiving trays 178 through the water passage holes 62 and drained outside via the water collecting pipe 180.

Since the left and right endless filter cloth belts 24*a* and 24*b* are obliquely outwardly separated from the left and right dewatering drum gears 18*a* and 18*b*, the dewatered cakes fall into the collecting hopper 28 and discharged outside by the discharging conveyer 190.

At the same time, the left and right brush rollers 182a and 182b brushes the lower surfaces of the left and right endless filter cloth belts 24a and 24b respectively to clean the meshes of the filter cloth belts.

When the belts 24a and 24b pass around the left and right dewatering rollers 90a and 90b, the belts are dewatered by the rollers 90a and 90b and the receiver rollers 114a and 114b and guided upwardly.

The tension rollers 116 are contacting with the upper surfaces of the filter cloth belts 24a and 24b between the supporting rollers 88a and 88b and the meshing location of the drum gears 18a and 18b to apply tension to the belts 24a and 24b. Therefore, the belts 24a and 24b are prevented from folding and being bitten. As a result, the belts 24a and 24b may not be deteriorated easily and may not prevent the traveling motion. If the belts 24a and 24b come out of the correct traveling paths, the belts will touch with the sensors 152 that are limit switches to turn ON the limit switches to provide electric signals to the traveling path correctors 154. Then, the rods of the cylinder mechanisms on the proper sides of the correctors 154 extend to push the traveling path correcting rollers 176 against the belts to correct the paths.

The continuous dewatering apparatus of the present invention is not limited by the above-mentioned embodiment, but, for instance, the shape of tooth of each of the drum gears may be a sawtooth form or a triangle.

Second Embodiment

FIGS. 33 to 40 show the second embodiment of the present invention. In the figures, the same parts as those of the first embodiment are indicated with like numerals to omit their explanations.

As shown in FIGS. 33 to 37, a continuous dewatering apparatus 10 of the second embodiment comprises left and right dewatering drum gears 18a and 18b, left and right presser gears 196a and 196b having smaller diameters than the drum gears 18a and 18b and disposed above the drum gears 18a and 18b to mesh with the drum gears 18a and 18b, and left and right holding roller pairs 198a and 198b. Left and right endless filter cloth belts 24a and 24b are stretched each in a V-shape around the left and right dewatering drum gears 18a and 18b, left and right lower holding rollers 198ad and 198bd and left and right dewatering rollers 90a and 90b.

Figure 33:
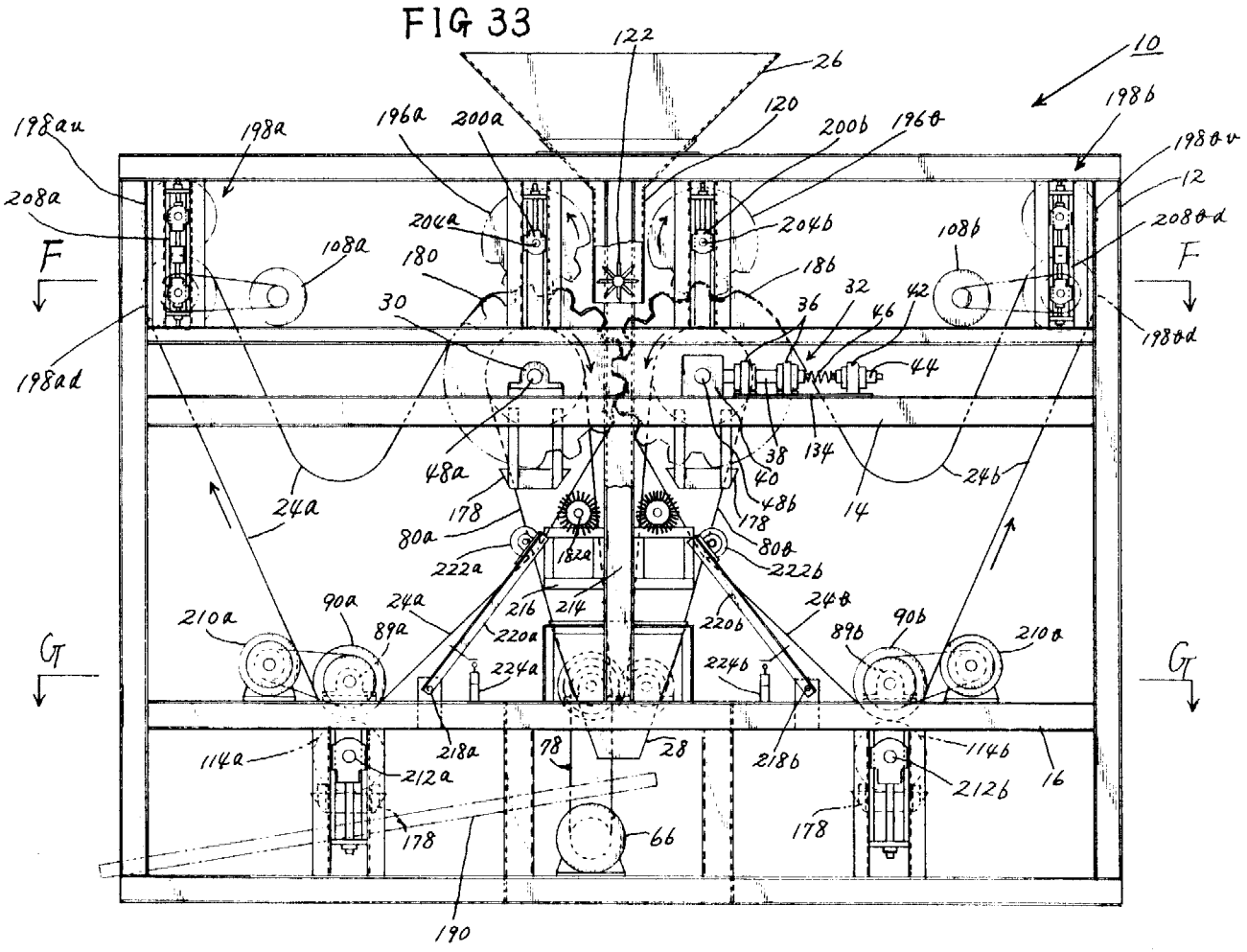
FIG. 33 is a front view showing essential part of a continuous dewatering apparatus according to a second embodiment of the present invention.
Figure 34:
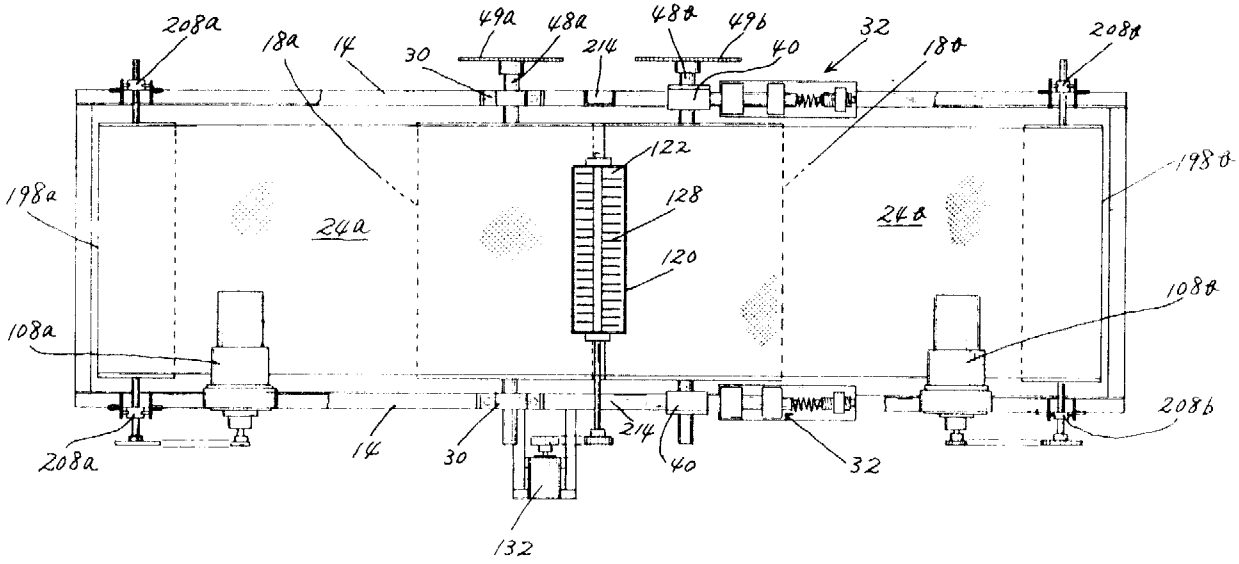
FIG. 34 is a sectional view taken along a line F—F of FIG. 33.
Figure 35:
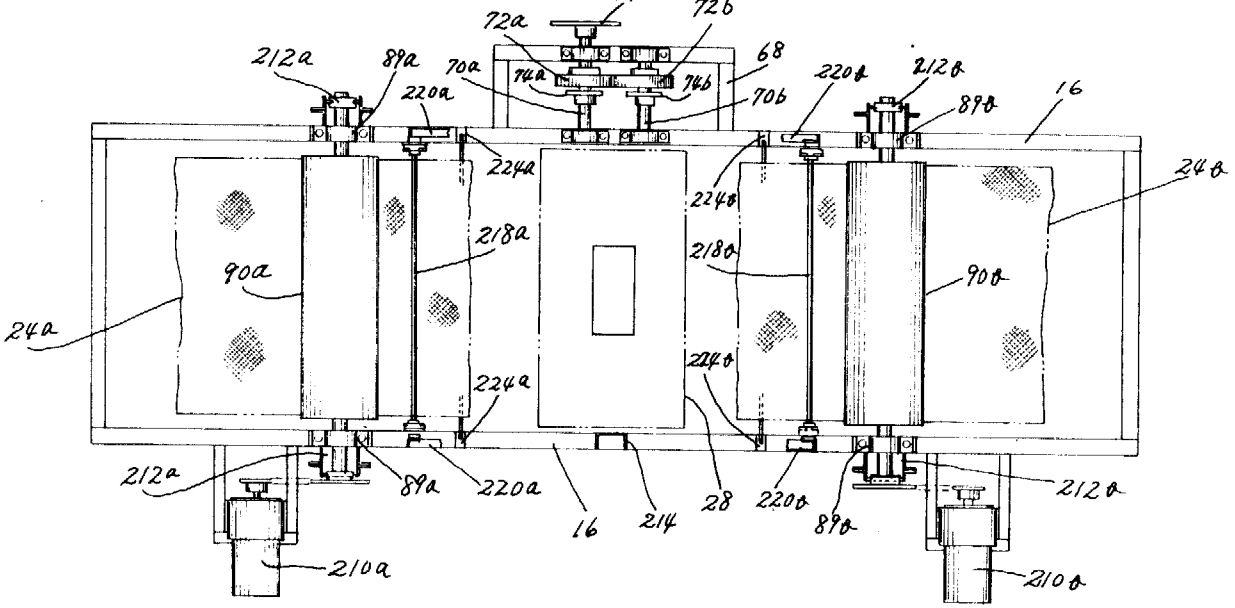
FIG. 35 is a sectional view taken along a line G—G of FIG. 33.

In FIG. 33, the continuous dewatering apparatus 10 has the left and right dewatering drum gears 18a and 18b that are supported at central portions of an upper horizontal frame 14 similar to the first embodiment.

Movable bearing mechanisms 32 each with spring and the same constitution as that of the first embodiment are disposed on the upper horizontal frame 14 so that the spring force of each spring 46 pushes the right dewatering drum gear 18b supported by bearings 40 toward a meshing location of the drum gears.

Figure 37:
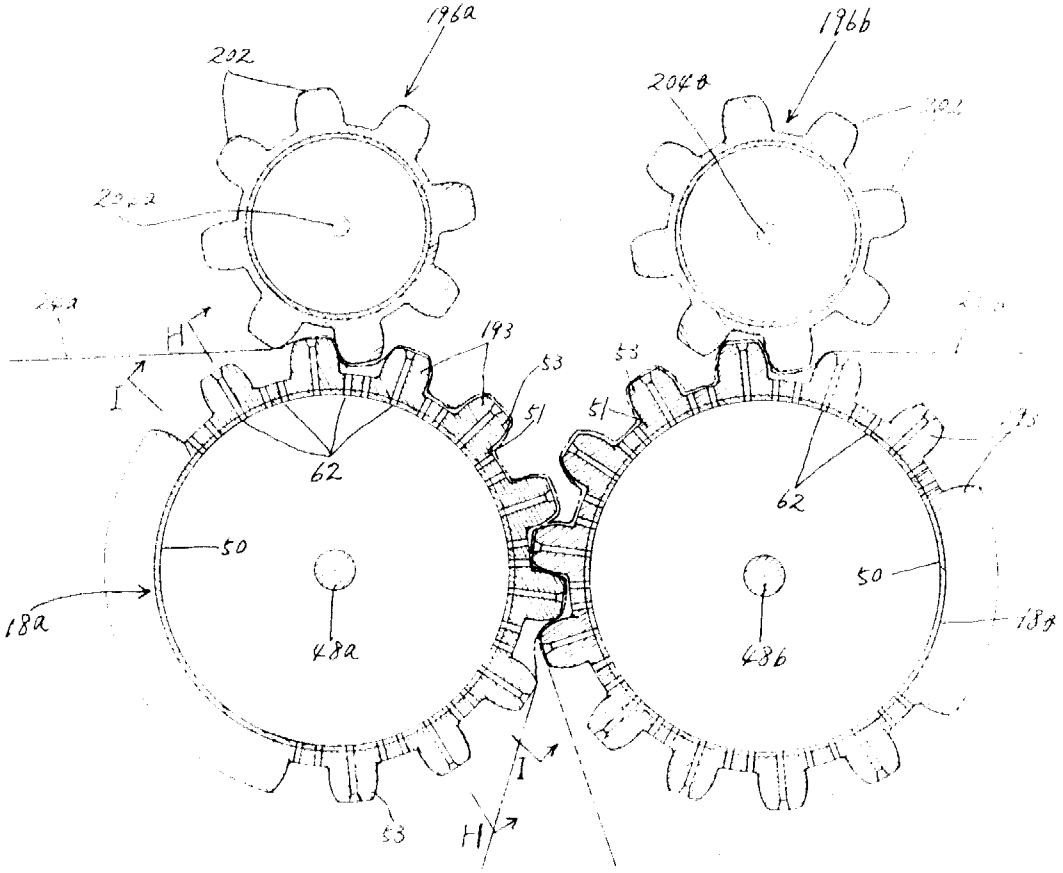
FIG. 37 is an enlarged vertical section showing left and right dewatering drum gears and left and right belt presser gears.
Figure 38:
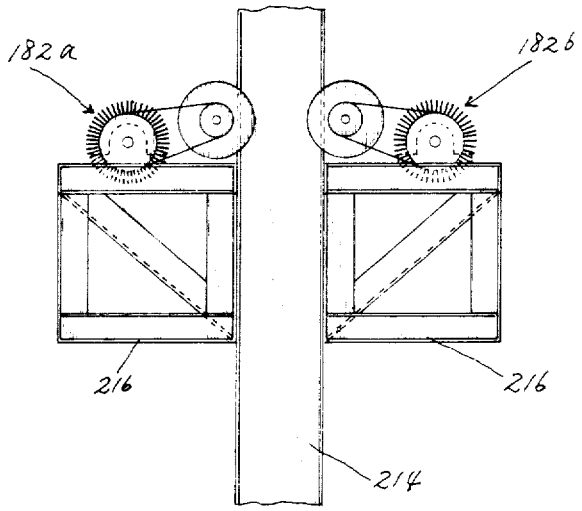
FIG. 38 is an enlarged front view showing part of bearing portions of brush rollers.
Figure 39:
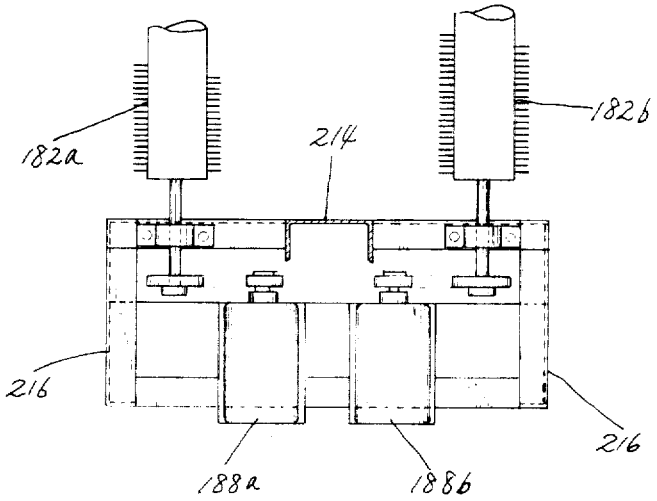
FIG. 39 is an enlarged plan view showing the same.
Figure 40:
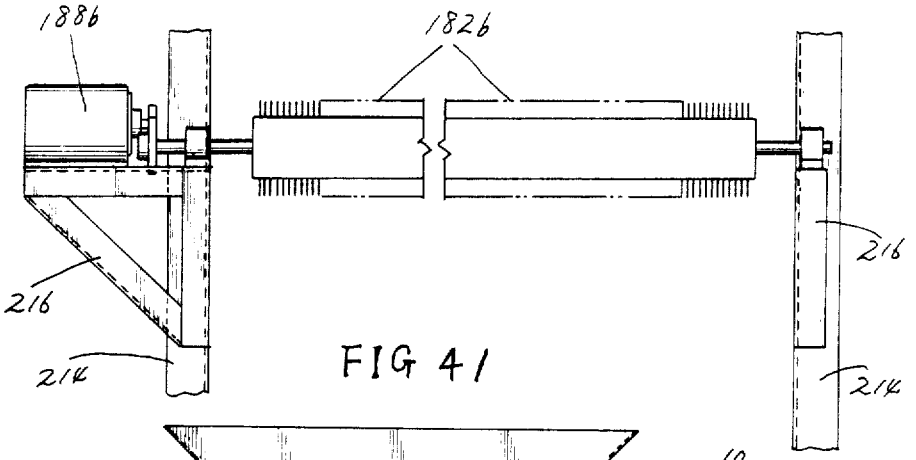
FIG. 40 is an enlarged side view showing a fitting state of one of the brush rollers.
Figure 41:
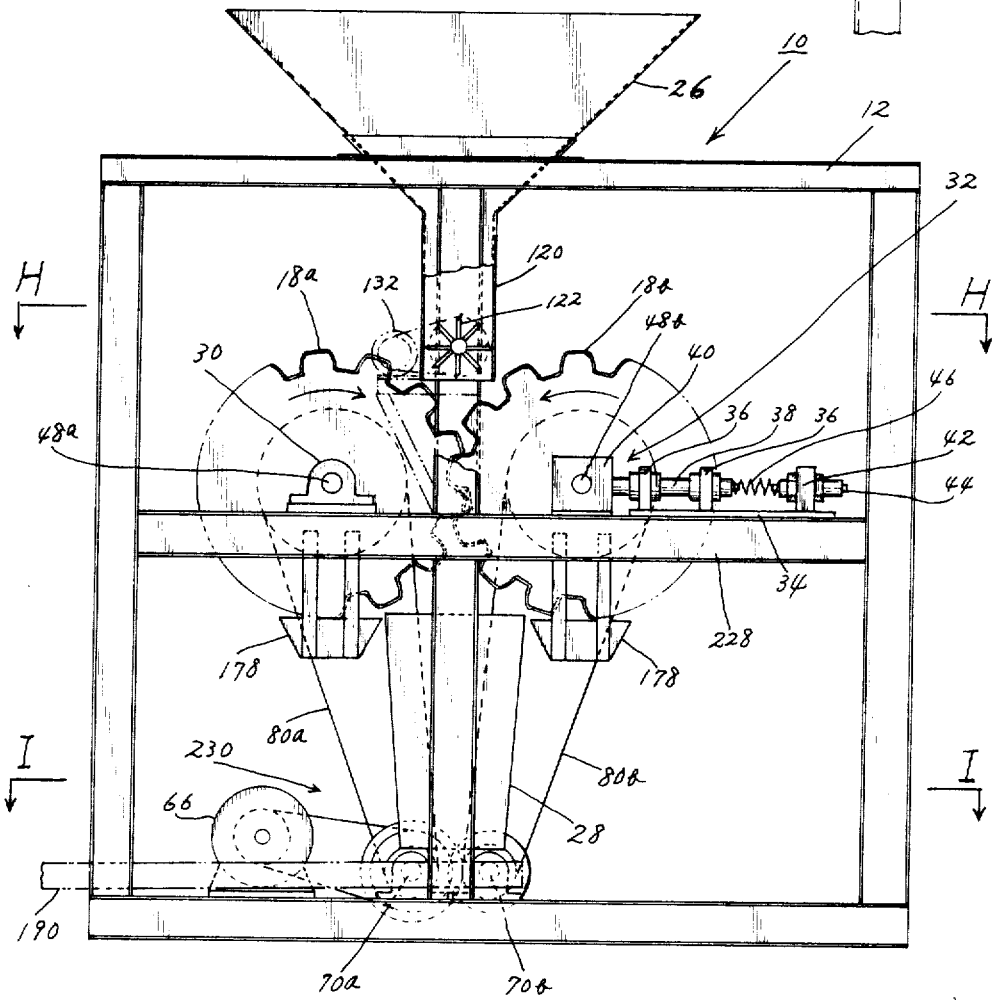
FIG. 41 is a front view showing essential part of a continuous dewatering apparatus according to a third embodiment of the present invention.
Figure 42:
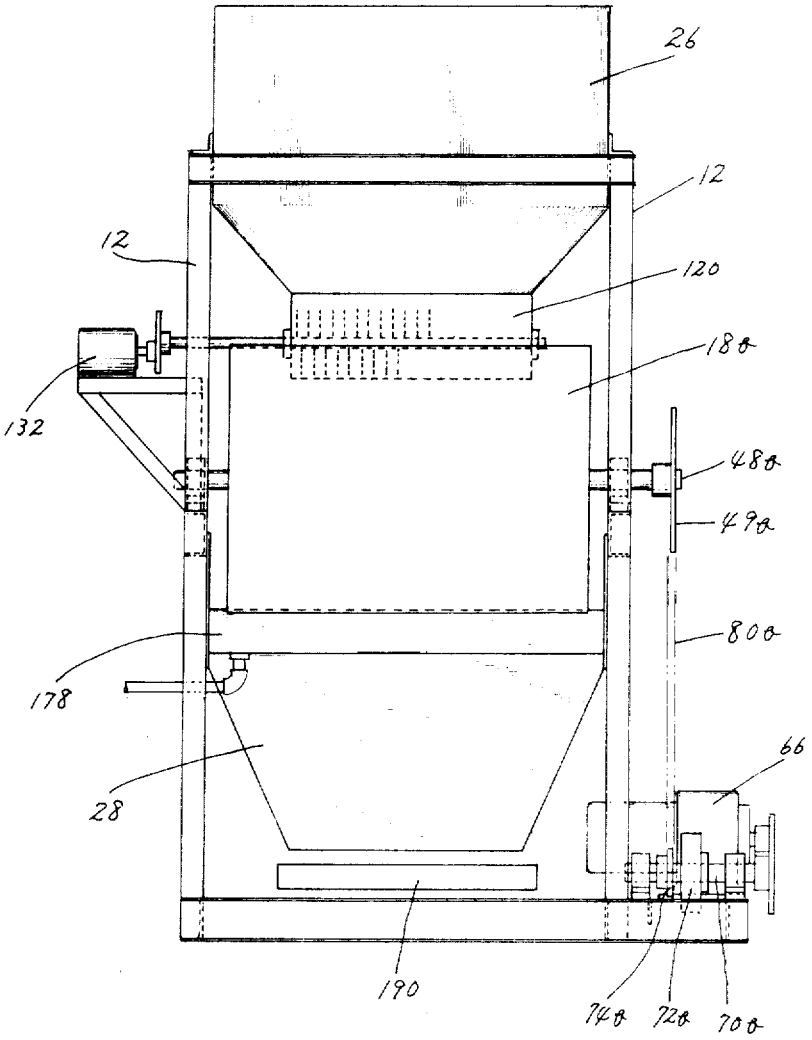
FIG. 42 is a right side view showing the third embodiment.
Figure 43:
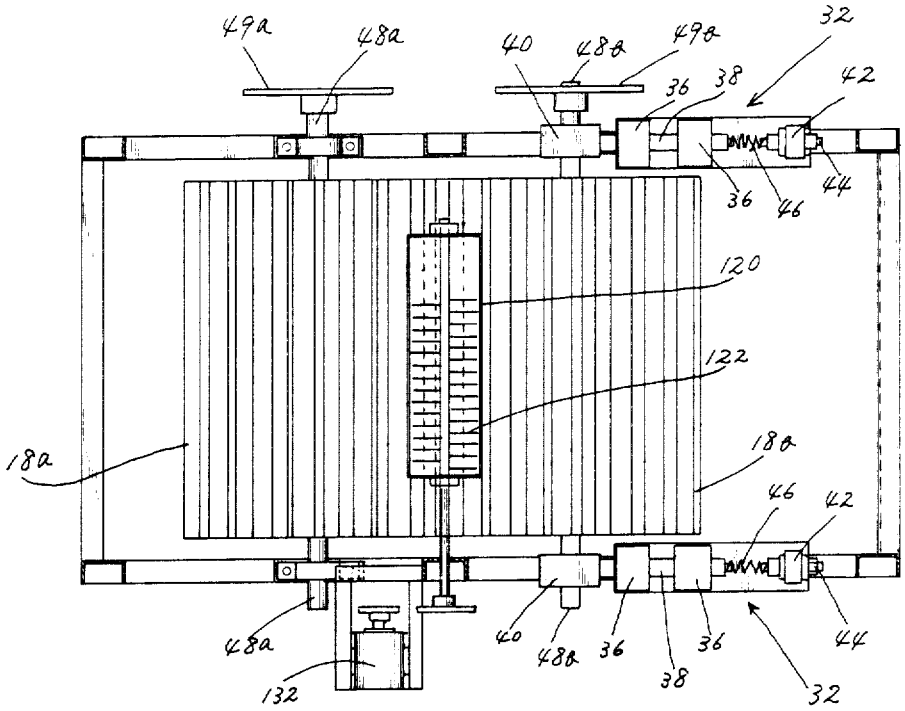
FIG. 43 is a sectional view taken along a line H—H of FIG. 41.
Figure 44:
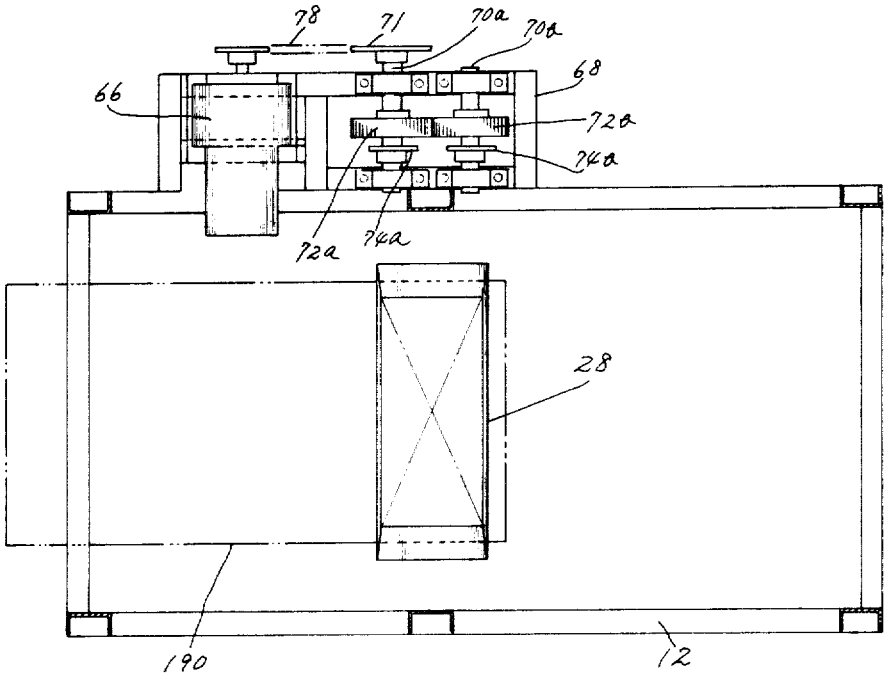
FIG. 44 is a sectional view taken along a line I—I of FIG. 41.
Figure 45:
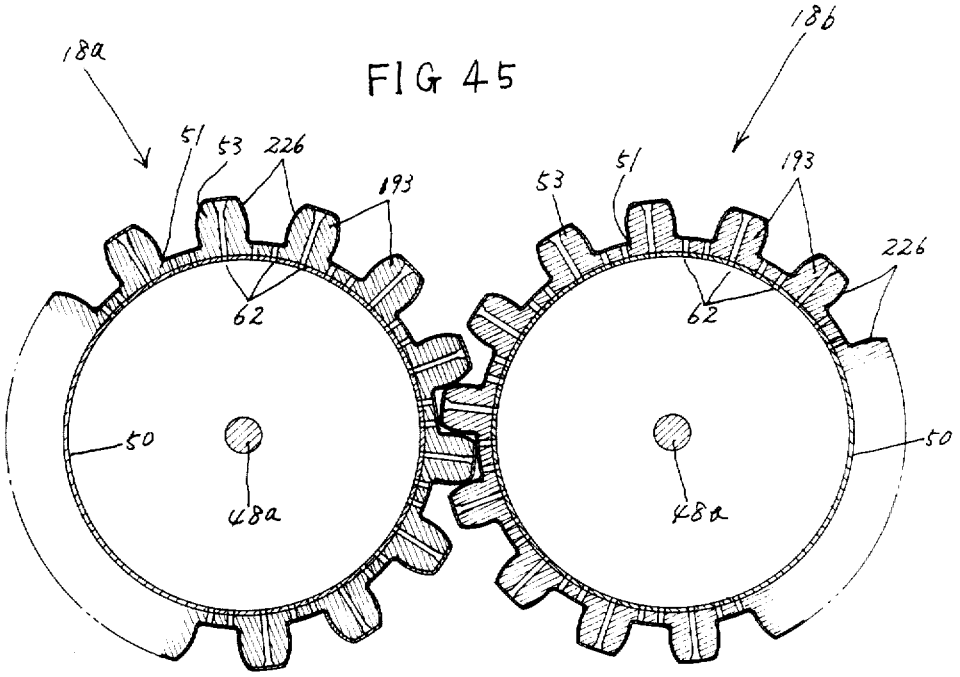
FIG. 45 is an enlarged vertical section showing left and right dewatering drum gears of the third embodiment.

As shown in FIG. 37, each of the drum gears 18a and 18b of the second embodiment comprises a metal cylindrical drum 50 and a plurality of elastic teeth 193 formed on the periphery of the drum 50. Each of the teeth 193 comprises an elastic base 51 formed of urethane rubber fixed to the periphery of the drum 50 with adhesives to form bottom lands, and a tooth head portion 53 protruding from the elastic base 51 to form a tooth crest. The elastic teeth 193 are formed integral to the periphery of the cylindrical drum 50.

As shown in the figure, many water passage holes 62 are formed through the tooth crests and bottom lands of the teeth 193. Therefore, the periphery of each of the drum gears 18a and 18b communicates with a hollow inside of the drum through the water passage holes 62.

As shown in FIG. 33, left first adjustable bearings 200a and right first adjustable bearings 200b are disposed above the bearings 30 and 40 on the front and rear sides of the frame 12, respectively. The bearings 200a and 200b are vertically adjustable and support rotary shafts 204a and 204b of the left and right presser gears 196a and 196b, respectively. The presser gears 196a and 196b are meshing with the left and right dewatering drum gears 18a and 18b, respectively. A diameter of each of the left and right presser gears 196a and 196b is smaller than a diameter of each of the left and right dewatering drum gears 18a and 18b. Each of the presser gears 196a and 196b has elastic teeth 202 formed on the periphery thereof. A pitch of the teeth 202 is the same as that of the teeth 193 of the drum gears 18a and 18b.

Figure 36:
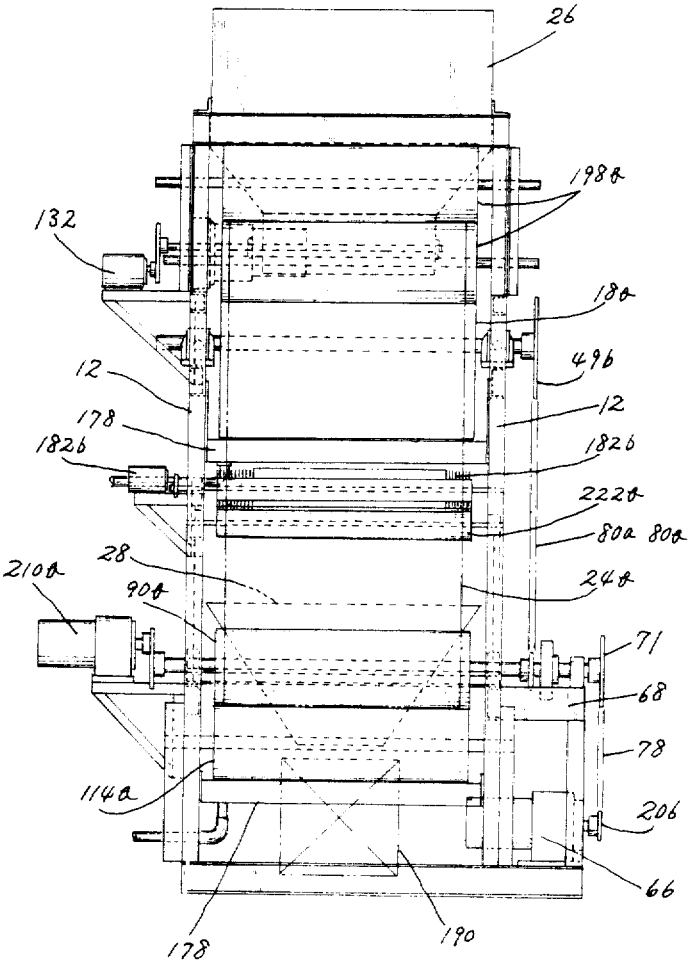
FIG. 36 is a right side view showing the continuous dewatering apparatus of the second embodiment.

In FIG. 36, a main motor 66 is disposed at a lower central portion of the frame 12 on the rear side. A chain pulley 206 is fixed to an end of an output shaft of the main motor 66. Above the motor 66, a receiver frame 68 is disposed. As shown in FIG. 36, there are disposed bearings on the upper surfaces of the receiver frame 68 and on a lower horizontal frame 16. Left and right rotary shafts 70a and 70b are supported by the bearings. An end of the left rotary shaft 70a projects from the bearing fixed to the receiver frame 68, and a chain pulley 71 is fixed to the protruding end. To the left and right rotary shafts 70a and 70b, left and right gears 72a and 72b meshing with each other, and left and right first chain pulleys 74a and 74b are fixed. An endless chain 78 is stretched around the chain pulley 206 fixed to the rotary shaft of the main motor 66 and the chain pulley 71. Left and right first endless chains 80a and 80b are stretched around the left and right first chain pulleys 74a and 74b of the left and right rotary shafts 70a and 70b and the left and right chain pulleys 49a and 49b fixed to rear ends of the rotary shafts 48a and 48b of the left and right dewatering drum gears 18a and 18b.

Left second vertical adjustable bearings 208a and right second vertical adjustable bearings 208b are disposed on both sides and on the front and rear sides of the frame 12. In each of the bearings 208a and 208b, a pair of bearings are vertically disposed such that a gap between them is adjustable with bolt and nut. The left second vertical adjustable bearings 208a support the left holding rollers 198au and 198ad, while the right second vertical adjustable bearings 208b support the right holding rollers 198bu and 198bd.

Left and right first motors are disposed on one sides of the left and right second vertical adjustable bearings 208a and 208b to drive the left and right holding lower rollers 198ad and 198bd.

On both sides of the lower horizontal frames 16 of the frame 12, bearings 89a and 89b are disposed. The left bearings 89a support a left dewatering roller 90a, while the right bearings 89b support a right dewatering roller 90b. In the vicinity of the left and right dewatering rollers 90a and 90b, bases are projectingly formed. On the bases, left and right second motors 210a and 210b are disposed. The motors 210a and 210b are interlocked with the dewatering rollers 90a and 90b, respectively.

Below the left and right dewatering rollers 90a and 90b and on the front and back sides of the frame 12, left third adjustable bearings 212a and right third adjustable bearings 212b are disposed to face each other. The left third adjustable bearings 212a support a left dewatering receiver roller 114a contacting with the lower surface of the left dewatering roller 90a, while the right third adjustable bearings 212b support a right dewatering receiver roller 114b contacting with the lower surface of the right dewatering roller 90b.

Water receiving trays 178 are disposed under the left and right dewatering drum gears 18a and 18b and the left and right dewatering receiver rollers 114a and 114b, respectively.

The left endless filter cloth belt 24a is stretched in a V-shape around the left dewatering drum gear 18a, left holding lower roller 198a and left dewatering roller 90a. The right endless filter cloth belt 24b is stretched in a V-shape around the right dewatering drum gear 18b, right holding lower roller 198b and right dewatering roller 90b.

A charging hopper 26 having a discharging square pipe portion 120 is disposed at an upper central portion of the frame 12. In the discharging square pipe portion 120, a rotary cutter 122 is rotatably supported and driven by a cutter driving motor 132.

Between the upper and lower horizontal frames 14 and 16, front and rear supports 214 are disposed. Bases are projectingly fixed to the supports 214 on which bearings are fixed. The bearings support left and right brush rollers 182a and 182b contacting with the lower surfaces of the left and right endless filter cloth belts 24a and 24b, respectively. Left and right brush driving motors 188a and 188b are fixed on the front bases 216 to drive the brush rollers 182a and 182b, respectively.

Left and right shafts 218a and 218b are journaled to the lower horizontal frames 16 on inner sides of the left and right dewatering rollers 90a and 90b. On both ends of the left and right shafts 218a and 218b, left arm levers 220a and right arm levers 220b are fitted. At upper ends of the left arm levers 220a, a left tension roller 222a for the left endless filter cloth belt 24a is supported. At upper ends of the right arm levers 220b, a right tension roller 222b for the right endless filter cloth belt 24b is supported.

A collecting hopper 28 is disposed under the left and right brush rollers 182a and 182b, and a discharge conveyer 190 is disposed under the collecting hopper 28 to extend to the outside of the frame 12.

Sludge, fruits and vegetables and wastes of processed fruits and vegetables are charged into the charging hopper 26, dropped between the endless filter cloth belts 24a and 24b rotating together with the drum gears 18a and 18b, and dewatered due to meshing pressure of the drum gears 18a and 18b. Water of the objects is filtered and drained into the drum gears 18a and 18b and then to the outside. Dewatered cakes are dropped from the belts 24a and 24b and discharged outside.

In the figures, numerals 224a and 224b represent sensor switches.

An operation of the continuous dewatering apparatus 10 according to the second embodiment will be described.

The main motor 66 drives the left and right rotary shafts 70a and 70b supported on the receiver frame 68 of the frame 12 to drive the left and right dewatering drum gears 18a and 18b. At the same time, the left and right holding rollers 198a and 198b are driven by the left and right first motors 108a and 108b, while the left and right dewatering rollers 90a and 90b are driven by the left and right second motors 210a and 210b. As a result, the left and right endless filter cloth belts 24a and 24b contacting with the peripheries of the drum gears 18a and 18b travel inwardly.

After that, objects to be dewatered are charged into the charging hopper 26, cut in pieces with the rotary cutter 122 in the discharging square pipe portion 120, and dropped downward. The objects are dropped between the left and right endless filter cloth belts 24a and 24b attached to the teeth of the left and right dewatering drum gears 18a and 18b that are rotated due to meshing and feeding motions of the left and right belt presser gears 196a and 196b. Then, the objects are pressed by the teeth 193 of the drum gears 18a and 18b so that the water content of the objects is drained into the drum gears 18a and 18b through the water passage holes 62 formed through the tooth crests and bottom lands of the teeth 193. Depending on a remaining amount of dewatered cakes of the objects, the movable bearings 40 supporting the rotary shaft 48b of the right dewatering drum gear 18b moves rightward against the coil spring 46 to adjust a meshing gap of the drum gears 18a and 18b.

The water flown into the drum gears 18a and 18b flows into the water receiving trays 178 through the water passage holes 62 and then to the outside similar to the first embodiment. The dewatered cakes drop into the collecting hopper 28 and discharged outside by the discharging conveyer 190. At the same time, the left and right brush rollers 182a and 182b brush the lower surfaces of the left and right endless filter cloth belts 24a and 24b to clean the meshes of the belts.

When the left and right endless filter cloth belts 24a and 24b pass between the left and right dewatering rollers 90a and 90b and the left and right dewatering receiver rollers 114a and 114b, the belts 24a and 24b are dewatered by the rollers and guided upward. The left and right tension rollers 222a and 222b apply tension onto the belts 24a and 24b. If the belts 24a and 24b are too loosened, probes of the sensor switches 224a and 224b detect the same to increase the speeds of the first and second motors 108 and 210.

Third Embodiment

FIGS. 41 to 45 show the third embodiment of the present invention. In the figures, the parts same as those shown in the first embodiment are represented with like reference marks to omit their explanations.

In a continuous dewatering apparatus 10 of the third embodiment, each cylindrical drum 50 has teeth 193 formed integral to the drum 50. A filter cloth 226 made of woven flax or chemical fibers is directly adhered to the tooth crests and bottom lands of the teeth 193 of the drum 50. Therefore, not like the first and second embodiments, the endless filter cloth belts and the roller groups around which the cloth belts are stretched are not used in the third embodiment.

Between the front and rear sides of a frame 12, horizontal frames 228 are arranged. On the horizontal frames 228, movable bearing mechanisms 32 each with a spring and the same constitution as that of the first embodiment are fitted respectively.

As shown in FIGS. 41 to 45, bearings 30 and 40 support left and right dewatering drum gears 18a and 18b respectively such that the teeth 193 of the drum gears 18a and 18b mesh with each other.

Each of the left and right dewatering drum gears 18a and 18b comprises the metal cylindrical drum 50 and the elastic teeth 193 fixed to the periphery of the drum 50. Each of the teeth 193 comprises an elastic base 51 made of urethane rubber to form a bottom land and a tooth head portion 51 projecting from the elastic base 51 to form a tooth crest. The elastic teeth 193 are formed integral to the periphery of the drum 50.

Many water passage holes 62 are formed through the tooth crests and bottom lands of the teeth 193. Therefore, the outside of each of the left and right dewatering drum gears 18*a* and 18*b* communicates with the inside thereof through the water passage holes 62.

The third embodiment is characterized in that the filter cloth 226 made of woven flax or chemical fibers is directly adhered with resin adhesives, etc., to the tooth crests and bottom lands of the teeth 193 integrally formed on the cylindrical drum 50 of each of the left and right dewatering drum gears 18*a* and 18*b*.

Therefore, the third embodiment is not provided with the roller groups for stretching the left and right endless filter cloth belts as in the cases of the first and second embodiments.

The third embodiment comprises the left and right dewatering drum gears 18*a* and 18*b*, a driving unit 230 for driving the drum gears 18*a* and 18*b*, a charging hopper 26 disposed above a meshing location of the drum gears 18*a* and 18*b* to receive objects to be dewatered, a collecting hopper 28, and a rotary cutter 122 disposed in a square pipe portion 120 of the charging hopper 26 and driven by a cutter driving motor 132.

The driving unit 230 comprises left and right rotary shafts 70*a* and 70*b* supported by bearings disposed on a receiver frame 68 and on the frame 12, left and right gears 72*a* and 72*b* fixed to the left and right rotary shafts 70*a* and 70*b* and meshing with each other, and left and right first chain pulleys 74*a* and 74*b* fixed to the left and right rotary shafts 70*a* and 70*b*. An endless chain 78 is stretched around a chain pulley 71 fixed to an end of the left rotary shaft 70*a* and the main motor 66. Left and right first endless chains 80*a* and 80*b* are stretched around the left and right first chain pulleys 74*a* and 74*b*, respectively.

An operation of the third embodiment will be described.

Objects to be dewatered are charged into the charging hopper 26 and cut into pieces by the rotary cutter 122 disposed in the discharging square pipe portion 120. Then, the objects are dropped onto a meshing portion of the left and right dewatering drum gears 18*a* and 18*b* and compressed with the meshing force of the drum gears 18*a* and 18*b*. Water content of the objects is drained into the dewatering drum gears 18*a* and 18*b* through the filter cloths 226 and water passage holes 62 and then drained from the lower part of the drum gears 18*a* and 18*b* into water receiving trays 178 disposed under the drum gears 18*a* and 18*b*.

As described in the above, the third embodiment does not require the endless filter cloth belts, belt presser gears, and roller groups such as the holding rollers, dewatering rollers and dewatering receiver rollers so that a compact apparatus will be realized, and the manufacturing cost will be reduced.

What is claimed is:

1. A continuous dewatering apparatus for dewatering objects such as sludge, fruits and vegetables and wastes of processed fruits and vegetables, comprising:

first and second dewatering drum gears meshing with each other at a meshing location and rotatably disposed within a frame;

a main driving unit for driving said dewatering drum gears;

first and second roller groups disposed on said frame adjacent to said dewatering drum gears respectively for rotation with said drum gears;

first and second endless filter cloth belts stretched around respectively said first and second dewatering drum gears and said roller groups, respectively;

a charging hopper disposed above said meshing location of said said dewatering drum gears to receive said objects to be dewatered; and collecting means disposed vertically below said dewatering drum gears for collecting water drained from said dewatering drum gears, each of said dewatering drum gears having a plurality of teeth formed on the periphery thereof with at least some of said teeth having a crest and with bottom lands being provided between adjacent said teeth and water passages formed through the crests and bottom lands, said objects to be dewatered being charged into said charging hopper and compressed under meshing pressure of said dewatering drum gears so that water contained in said objects is separated from said objects and drained through said endless filter cloth belts into said drum gears and then to the outside of said continuous dewatering apparatus;

said apparatus further comprising annular soft rubber members each stretched along a side edge of one of said first and second endless filter cloth belts, said annular soft rubber members elastically and inwardly tightening said one belt and rotating together with said one belt around the corresponding one of said first and second dewatering drum gears and the corresponding one group of said first and second roller groups, to prevent the dewatered cakes and separated water of said objects from flowing sideward from said dewatering drum gears meshing with each; and contact position regulating mechanisms for regulating the contact positions of said annular soft rubber members with respect to the side edge portions of said one filter cloth belt, said contact position regulating mechanisms being provided on the traveling paths of said annular soft rubber members at least above said meshing location of said dewatering drum gears and having guide rollers rotatably contacting with said soft rubber members.

* * * * *